US007364823B2

(12) United States Patent
Kondoh et al.

(10) Patent No.: US 7,364,823 B2
(45) Date of Patent: Apr. 29, 2008

(54) AMINE COMPOUND, ELECTROPHOTOGRAPHIC PHOTORECEPTOR USING THE AMINE COMPOUND AND IMAGE FORMING APPARATUS HAVING THE SAME

(75) Inventors: Akihiro Kondoh, Nara (JP); Takatsugu Obata, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 349 days.

(21) Appl. No.: 11/092,917

(22) Filed: Mar. 30, 2005

(65) Prior Publication Data

US 2005/0238973 A1 Oct. 27, 2005

(30) Foreign Application Priority Data

Mar. 30, 2004 (JP) ..... P2004-100433

(51) Int. Cl.
*G03G 5/06* (2006.01)

(52) U.S. Cl. ..... 430/58.65; 430/75; 430/76; 549/467; 399/159

(58) Field of Classification Search ..... 430/75, 430/58.65, 78; 399/159; 549/467
See application file for complete search history.

(56) References Cited

U.S. PATENT DOCUMENTS

| | | | | |
|---|---|---|---|---|
| 3,765,882 | A * | 10/1973 | Virkhaus | 430/75 |
| 3,824,099 | A | 7/1974 | Champ et al. | |
| 4,123,269 | A | 10/1978 | Von Hoene et al. | |
| 4,150,987 | A | 4/1979 | Anderson et al. | |
| 4,278,747 | A | 7/1981 | Murayama et al. | |
| 4,338,388 | A | 7/1982 | Sakai et al. | |
| 4,367,273 | A | 1/1983 | Murayama et al. | |
| 4,859,556 | A | 8/1989 | Sasaki | |
| 4,892,949 | A | 1/1990 | Sasaki | |
| 5,219,688 | A * | 6/1993 | Kashizaki et al. | 430/75 |
| 5,677,095 | A * | 10/1997 | Kikuchi et al. | 430/75 |
| 5,853,930 | A * | 12/1998 | Kondoh | 430/75 |
| 6,150,063 | A | 11/2000 | Sugimura et al. | |
| 2005/0171184 | A1* | 8/2005 | Aoki et al. | 549/467 |
| 2005/0261347 | A1* | 11/2005 | Gross et al. | 549/467 |

FOREIGN PATENT DOCUMENTS

| | | |
|---|---|---|
| JP | B 52-4188 | 2/1977 |
| JP | A 54-150128 | 11/1979 |
| JP | A 54-151955 | 11/1979 |
| JP | A 55-52063 | 4/1980 |
| JP | B 55-42380 | 10/1980 |
| JP | B 58-32372 | 7/1983 |
| JP | A 58-198043 | 11/1983 |
| JP | A 2-190862 | 7/1990 |
| JP | A 2000-338696 | 12/2000 |

* cited by examiner

*Primary Examiner*—Christopher RoDee
(74) *Attorney, Agent, or Firm*—Nixon & Vanderhye P.C.

(57) ABSTRACT

An amine compound represented by the following general formula (1) is incorporated as a charge-transporting substance into a charge-transporting layer of an electrophotographic photoreceptor.

(1)

10 Claims, 3 Drawing Sheets

AMINE COMPOUND, ELECTROPHOTOGRAPHIC PHOTORECEPTOR USING THE AMINE COMPOUND AND IMAGE FORMING APPARATUS HAVING THE SAME

BACKGROUND OF THE INVENTION

1. Field of the Invention

The present invention relates to an amine compound, an electrophotographic photoreceptor using the amine compound and an image forming apparatus having the same.

2. Description of the Related Art

An image forming apparatus for forming images using electrophotographic technology (hereinafter referred to as an electrophotographic apparatus) has been used frequently such as for copying machines, printers or facsimile units. In the electrophotographic apparatus, images are formed by way of the following electrophotographic process. At first, a photosensitive layer of an electrophotographic photoreceptor equipped in the apparatus (hereinafter referred to as a photoreceptor) is uniformly charged to a predetermined potential by charging means such as a charging roller, applying exposure in accordance with image information by exposure means, thereby forming an electrostatic latent image on the photoreceptor. A developer is supplied to the formed electrostatic latent images and a toner as a component of the developer is adhered to the surface of the photoreceptor to develop the electrostatic latent image and visualize it as toner images. Thus formed toner image is transferred by transfer means from the surface of the photoreceptor onto a transfer material such as recording paper and fixed onto the transfer material by fixing means. Further, cleaning is applied to the photoreceptor after transfer of the toner image by cleaning means having a cleaning blade, etc. thereby eliminating the toner and the like remaining on the surface of the photoreceptor not transferred to the transfer material during transfer operation. Then, the surface of the photosensitive layer is charge-eliminated by a charge eliminator or the like to erase the electrostatic latent image.

In recent years, the electrophotography has been utilized not restricted only to the field of the image forming apparatus such as copying machines but utilized also in the field, for example, of printing plate materials, slide films or microfilms for which photography has been used so far, and it is also applied to high speed printers using lasers, Light Emitting Diode (abbreviated as LED) or Cathode Ray Tube (abbreviated as CRT) as a light source. Along with extension of the application range of the electrophotography, the demand for the electrophotographic photoreceptor has become higher and more versatile.

An electrophotographic photoreceptor is constituted by laminating a photosensitive layer containing a photoconductive material on a conductive support formed of a conductive material. As the electrophotographic photoreceptor, an inorganic photoreceptor having a photosensitive layer mainly containing an inorganic photoconductive material such as selenium, zinc oxide or cadmium has been used generally. While the inorganic photoreceptor has basic properties as the photoreceptor to some extent, it involves a problem such that the formation of the film for the photosensitive layer is difficult and plasticity is poor, and the production cost is expensive. Further, since the inorganic photoconductive material generally has high toxicity and suffers from great restriction in view of production and handling.

As described above, since the inorganic photoconductive material and the inorganic photoreceptor using the same involve many drawbacks, research and development have been progressed for organic photoconductive materials. Further, the organic photoconductive material has been studied and developed generally in recent years and it has been utilized not only for electrostatic recording devices such as the electrophotographic photoreceptor but also has been applied, for example, to sensor materials or organic Electro Luminescent (abbreviated as EL) devices.

The organic photoreceptor using the organic photoconductive material has advantages such that the film formation property for the photosensitive layer is favorable and the flexibility is excellent, as well as it is light in the weight, excellent in the transparency, and a photoreceptor showing good sensitivity to a wavelength region over a wide range can be designedeasilybyanappropriate sensitizingmethod. Thus, the organic photoreceptor has been under development as a predominant candidate for the electrophotographic photoreceptor.

While the organic photoreceptor has drawbacks in view of the sensitivity and the durability in the early stage, such drawbacks have been improved remarkably by the development of a function separated electrophotographic photoreceptor in which charge-generating function and charge-transporting function are separately attained by different substances. Further, the function separated photoreceptor also has an advantage, in addition to the advantage of the organic photosensitive material described above, that the selection range for the material constituting the photosensitive layer is wide and an electrophotographic photoreceptor having optional characteristics can be manufactured relatively easily. The function separated photoreceptors include a lamination type and a single layer type. The lamination type function separated photoreceptor is provided with a lamination type photosensitive layer in which a charge-generating layer containing a charge-generating substance for charge-generating function and a charge-transporting layer containing a charge-transporting substance for charge-transporting function are laminated. The charge-generating layer and the charge-transporting layer are formed usually in a state where the charge-generating substance and the charge-transporting substance are dispersed respectively in a binder resin as a binder. Further, the single layer type function separated photoreceptor is provided with a photosensitive layer of a single layer type in which both of the charge-generating substance and the charge-transporting substance are dispersed in a binder resin.

As the charge-generating substance used in the function separated photoreceptor, various substances such as phthalocyanine pigment, squilirium dye, azo pigment, perylene pigment, polycyclic quinone pigment, cyanine dye, squalic acid dye and pyrylium salt dye have been studied and various materials of high light fastness and high charge-generating ability have been proposed.

Further, various compounds have been proposed as the charge-transporting material, for example, pyrazoline compounds (for example, refer to Japanese Examined Patent publication JP-B2 52-4188 (1977)), hydrazone compounds (for example, refer to Japanese Unexamined Patent Publication JP-A 54-150128 (1979), Japanese Examined Patent Publication JP-B2 55-42380 (1980), Japanese Unexamined Patent Publication JP-A 55-52063 (1980)), triphenylamine compounds (for example, refer to Japanese Examined Patent Publication JP-B2 58-32372 (1983), and Japanese Unexamined Patent Publications JP-A 2-190862 (1990) and stilbene compounds (for example, Japanese Unexamined Patent Publications JP-A 54-151955 (1979) and JP-A 58-198043 (1983)).

The charge-transporting substances must satisfy the following requirements:

(1) they are stable to light and heat, (2) they are stable to active substances such as ozone, nitrogen oxide (chemical formula: $NO_x$) and nitric acid generated by corona discharging in charging the photoreceptor, (3) they have high charge-transporting ability, (4) they have high compatibility with an organic solvent and a binder resin, and (5) they can be manufactured easily and inexpensively. However, while the charge-transporting substances disclosed in, for example, the above-stated JP-B252-4188, JP-A54-150128, JP-B2 55-42380, JP-A 55-52063, JP-B2 58-32372, JP-A 2-190862, and JP-A 54-151955, JP-A 58-198043, can satisfy a portion of the demands but have not yet satisfy all of the demands at high level.

Further, in recent years, of the above-stated demands, particularly high charge-transporting ability has been demanded for the charge-transporting substance. For example, higher sensitivity has been demanded as the photoreceptor characteristics corresponding to the requirement of reduction in the size and high speed operation to electrophotographic apparatuses such as copying machines and printers, and the charge-transporting ability of the charge-transporting substance has been demanded to improve as means for attaining higher sensitivity of the photoreceptor. Further, in the high speed electrophotographic process, since the time from exposure to the development is short, a photoreceptor of excellent light responsiveness has been required. In a case where the light responsiveness of the photoreceptor is poor, that is, the decaying speed of the surface potential of the photosensitive layer by exposure is slow, the residual potential rises and is used repetitively in a state where the surface potential is not decayed sufficiently. Therefore, the surface charges at a potion to be erased are not sufficiently erased by exposure to cause deterioration of the picture quality such as lowering of the image density in an early stage. In the function separated type photoreceptor, the charges generated from the charge-generating substance upon light absorption are transported by the charge-transporting substance to the surface of the photosensitive layer so that the surface charges of the photosensitive layer at a portion irradiated with a light are eliminated. Therefore, the light responsiveness depends on the charge-transporting ability of the charge-transporting substance. Accordingly, high charge-transporting ability is required for the charge-transporting substance also with a view point of attaining a photoreceptor having high light responsiveness and capable of forming high quality images also in a high speed electrophotographic process.

Further, high durability of the electrophotographic apparatus is also required. In order to attain the high durability, it is necessary that the electrophotographic photoreceptor has excellent durability to electric and mechanical external force and can operate stably for a long period of time. For example, as to the mechanical durability, durability of the surface layer of the photoreceptor is important. In a case where a photoreceptor is used being mounted on an electrophotographic apparatus, the surface layer of the photoreceptor is inevitably scraped at a portion thereof by a contact member such as a cleaning blade or a charge roller. In a case where the amount of film reduction on the surface layer of the photoreceptor is large, since the charge retainability of the photoreceptor is lowered failing to provide high quality images. Accordingly, in order to attain higher durability of the electrophotographic apparatus, it is demanded for a photoreceptor having a surface layer of high mechanical durability resistant to the contact member, that is, having a surface layer of high printing resistance with less amount of film reduction.

In the above-described photoreceptor having the charge-transporting layer as the surface layer, in order to increase the printing resistance of the surface layer and improve the mechanical durability of the photoreceptor, it is presumable to increase the content of the binder resin in the charge-transporting layer used as the surface layer. However, in a case where the content of the binder resin is increased, since the content of the charge-transporting substance in the charge-transporting layer is relatively decreased, this brings about a problem that the charge-transporting ability of the charge-transporting layer is deteriorated and the light responsiveness is lowered. Since the light responsiveness of the photoreceptor depends on the charge-transporting ability of the charge-transporting substance as described above, a particularly high charge-transporting ability is demanded for the charge-transporting substance also for increasing the content of the binder resin thereby improving the mechanical durability of the photoreceptor, without lowering the light responsiveness.

However, the charge-transporting ability of the charge-transporting substances disclosed in, for example, JP-B2 52-4188, JP-A 54-150128, JP-B2 55-42380, JP-A 55-52063, JP-B2 58-32372, JP-A 2-190862, JP-A 54-151955, and JP-A 58-198043, is not sufficient. Even with these charge-transporting substances, it is impossible to obtain a photoreceptor having sufficient sensitivity and light responsiveness for attaining reduction in the size, high speed operation, and high durability of the electrophotographic apparatus.

Further, it is demanded for the electrophotographic apparatus that uniform images can be provided irrespective of the working circumstance and it is also required for the photoreceptor that the characteristics less change by fluctuation of circumstances such as temperature and humidity and it is excellent in circumstantial stability. However, photoreceptors using charge-transporting substance as disclosed, for example, in the above-stated JP-B2 52-4188, JP-A 54-150128, JP-B2 55-42380, JP-A 55-52063, JP-B2 58-32372, JP-A 2-190862, JP-A54-151955, and JP-A58-198043, have no sufficient circumstantial stability. Particularly, the sensitivity and the light responsiveness under a low temperature circumstance are not sufficient and, when the electrophotographic apparatus having such photoreceptors are used under the low temperature circumstance, they result in a problem of causing degradation of picture quality such as lowering of image density.

SUMMARY OF THE INVENTION

The invention intends to provide an amine compound of high reliability capable of attaining an electrophotographic photoreceptor excellent in charge transportability, and favorable in the sensitivity and electric characteristics such as light responsiveness when used as the charge-transporting substance of the electrophotographic photoreceptor and excellent in electrical and mechanical durabilities and also excellent in circumstantial stability, as well as an electrophotographic photoreceptor using the amine compound and an image forming apparatus having the same.

The present inventors have made studies for solving the foregoing subject and found, as a result, that when a benzofuran ring in which a furan ring is condensed to an aromatic ring is used as a skeleton structure, an amino group substituted with a group containing an aromatic ring or heterocycle such as an aryl group or a heterocycle group is introduced to the benzofuran skeleton and, further, a diene structure or a triene structure is introduced, a conjugation system is formed over a wide range in the molecule to provide excellent charge transportability and particularly excellent hole transportability, and have accomplished the invention.

In other words, the invention provides an amine compound represented by the following general formula (1).

(1)

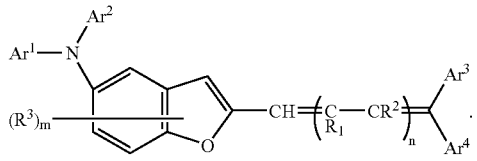

in the formula (1), $Ar^1$, $Ar^2$, and $Ar^3$ each represent an aryl group which may have a substituent, a heterocycle group which may have a substituent, an aralkyl group which may have a substituent or a thienyl methyl group which may have a substituent; and $Ar^4$ represents a hydrogen atom, an alkyl group which may have a substituent, an aryl group which way have a substituent, a heterocycle group which may have a substituent or an aralkyl group which may have a substituent. $Ar^3$ and $Ar^4$ may also form a ring structure together with a carbon atom bonded thereto. $R^1$ and $R^2$ each represent a hydrogen atom, an alkyl group which may have a substituent, an aryl group which may have a substituent, a heterocycle group which may have a substituent or an aralkyl group which may have a substituent. n represents an integer of 1 or 2, and in a case where n is 2, two $R^1$s may be identical or different and two $R^2$s may be identical or different. $R^3$ represents an alkyl group of 1 to 3 carbon atoms which may have a substituent, a fluoroalkyl group of 1 to 5 carbon atoms which may have a substituent, a perfluoroalkyl group of 1 to 5 carbon atoms, an alkoxy group of 1 to 3 carbon atoms which may have a substituent, a dialkyl amino group of 2 to 8 carbon atoms which may have a substituent, a halogen atom or a hydrogen atom. m represents an integer of 1 to 4, and in a case where m is 2 or more, plural $R^3$ s may be identical or different.

In the invention, it is preferable that the amine compound is an amine compound with n=1 in the general formula (1).

In the invention, it is preferable that the amine compound is an amine compound represented by the following general formula (2).

(2)

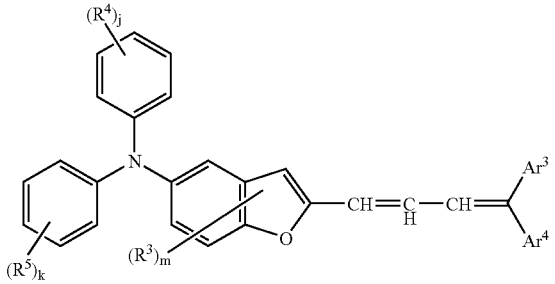

in the formula (2), $R^4$ and $R^5$ each represent an alkyl group of 1 to 3 carbon atoms which may have a substituent, a fluoroalkyl group of 1 to 5 carbon atoms which may have a substituent, a perfluroalkyl group of 1 to 5 carbon atoms, an alkoxy group of 1 to 3 carbon atoms which may have a substituent, a dialkylamino group of 2 to 8 carbon atoms which may have a substituent, a halogen atom or a hydrogen atom. j and k each represent an integer of 1 to 5, and in a case where j is 2 or more, plural $R^4$s may be identical or different and in a case where k is 2 or more, plural $R^5$s may be identical or different $Ar^3$, $Ar^4$, $R^3$ and m have the same meanings as those defined in the general formula (1).

Furthermore, the invention provides an electrophotographic photoreceptor comprising:

a conductive support formed of a conductive material; and a photosensitive layer provided on the conductive support and containing a charge-generating substance and a charge-transporting substance, wherein the charge-transporting substance contains the above-described amine compound of the invention.

Furthermore, in the invention, it is preferable that the charge-generating substance contains an oxotitanium phthalocyanine compound.

Furthermore, in the invention, it is preferable that the oxotitanium phthalocyanine compound is an oxotitanium phthalocyanine compound having a crystal structure which shows a diffraction peak at least at a Bragg angle 2θ (error: 2θ±0.2°) of 27.2° in an X-rays diffraction spectrum relative to Cu—Kα characteristic X-ray (wavelength: 1.54 Å).

Furthermore, in the invention, it is preferable that the photosensitive layer has a laminated structure formed by laminating a charge-generating layer containing the charge-generating substance and a charge-transporting layer containing the charge-transporting substance.

Furthermore, in the invention, it is preferable that the charge-transporting layer further contains a binder resin, and a ratio A/B between weight A of the amine compound represented by the general formula (1) and weight B of the binder resin in the charge-transporting layer is 10/30 or more and 10/12 or less.

Furthermore, in the invention, it is preferable that the electrophotographic photoreceptor further comprises an intermediate layer between the conductive support and the photosensitive layer.

Furthermore, the invention provides an image forming apparatus comprising:

the electrophotographic photoreceptor described above;

charging means for charging the electrophotographic photoreceptor;

exposure means for applying exposure to the charged electrophotographic photoreceptor; and developing means for developing an electrostatic latent image formed by exposure.

According to the invention, since the amine compound of the invention represented by the general formula (1) is excellent in the charge transportability, particularly, the hole transportability, it can be used suitably as the charge-transporting substance. For example, a device of excellent responsiveness can be provided by using the amine compound of the invention represented by the general formula (1) as a charge-transporting substance for devices such as an electrostatic recording device of an electrophotographic photoreceptor, etc., a sensor, or an EL device. Particularly, when the amine compound of the invention is incorporated as a charge-transporting substance in a photosensitive layer of an electrophotographic photoreceptor, it is made possible to attain an electrophotographic photoreceptor of high reliability, satisfactory in electric characteristics such as chargeability, sensitivity and light responsiveness, excellent in electrical and mechanical durabilities and circumstantial stability and capable of providing high quality images stably for a long period of time in various circumstances.

Furthermore, according to the invention, the amine compounds with n=1 are preferable among the amine compounds represented by the general formula (1). Since the amine compounds with n=1 in the general formula (1) have a benzofuran amine-diene structure that can be synthesized relatively easily, they can be produced at high synthesis yield and at relatively reduced costs. Accordingly, by using the amine compounds with n=1 in the general formula (1) for devices such as an electrostatic recording device of an electrophotographic photoreceptor, etc., a sensor or an EL device, the costs for manufacturing the devices can be reduced.

Furthermore, according to the invention, the amine compounds represented by the general formula (2) are further preferable among the amine compounds with n=1 in the general formula (1). Since the amine compounds represented by the general formula (2) have an N,N-diphenylbenzofurane-amine-diene structure which can be synthesized particularly easily, it can be produced at a further reduced cost. Accordingly, by using the amine compounds represented by the general formula (2) for the devices such as an electrostatic recording device of an electrophotographic photoreceptor, etc., a sensor or an EL device, costs for manufacturing the devices can be further reduced.

Furthermore according to the invention, the photosensitive layer of the electrophotographic photoreceptor contains the amine compound of the invention represented by the general formula (1) as the charge-transporting substance. This makes it possible to provide an electrophotographic photoreceptor of high reliability excellent in electric characteristics such as chargeability, sensitivity and light responsiveness and further excellent also in electrical durability and environmental stability. Images of high quality can be provided stably for a long period of time under various circumstances by using the electrophotographic photoreceptor according to the invention of excellent reliability.

Furthermore, according to the invention, it is preferable that the photosensitive layer of the electrophotographic photoreceptor contains as a charge-generating substance, an oxotitanium phthalocyanine compound, preferably, an oxotitanium phthalocyanine compound having a crystal structure which shows a diffraction peak at least at a Bragg angle 2θ (error:2θ±0.2°) of 27.2° in an X-ray diffraction spectrum relative to Cu—Kα characteristic X-rays (wavelength: 1.54 Å). Since the oxotitanium phthalocyanine compound has high charge-generating efficiency and charge injection efficiency, it generates a great amount of charges on absorption of light and injects the generated charges efficiently to the charge-transporting substance without storing them in its inside. Since the charge-transporting substance contains the amine compound of the invention excellent in the charge transportability, charges generated by light absorption at the oxotitanium phthalocyanine compound are efficiently injected to the charge-transporting substance containing the amine compound of the invention and transported smoothly to the surface of the photosensitive layer. Accordingly, an electrophotographic photoreceptor having particularly excellent sensitivity and further also excellent in the resolution power can be obtained by incorporating an oxotitanium phthalocyanine compound, preferably, an oxotitanium phthalocyanine compound having the specified crystal structure as the charge-generating substance to the photosensitive layer containing the amine compound of the invention as the charge-transporting substance.

Further, according to the invention, the photosensitive layer of the electrophotographic photoreceptor preferably has a laminated structure formed by laminating a charge-generating layer containing a charge-generating substance and a charge-transporting layer containing a charge-transporting substance containing the amine compound of the invention. By sharing the charge-generating function and the charge-transporting function on separate layers, the materials constituting the respective layers can be selected independently so that materials optimal to the charge-generating function and the charge-transporting function respectively can be selected. Accordingly, it is possible to improve the electric characteristics such as the chargeability, the sensitivity and the light responsiveness, as well as electrical and mechanical durabilities of the electrophotographic photoreceptor.

Furthermore, according to the invention, the ratio A/B between the weight A of the amine compound represented by the general formula (1) and the weight B of the binder resin contained in the charge-transporting layer is preferably 10/30 or more and 10/12 or less. This makes it possible to improve the printing resistance of the charge-transporting layer. While the light responsiveness may possibly be lowered when the ratio of the binder resin in the charge-transporting layer is increased, since the amine compound of the invention is excellent in the charge transportability as described above, the light responsiveness is maintained even when the ratio of the binder resin in the charge-transporting layer is increased by setting the ratio A/B to 10/12 or less. Accordingly, the printing resistance of the charge-transporting layer can be improved and the mechanical durability of the electrophotographic photoreceptor can be improved without lowering the light responsiveness by defining the ratio A/B to 10/30 or more and 10/12 or less.

Further according to the invention, an intermediate layer is provided between a conductive support and a photosensitive layer. Since this makes it possible to prevent injection of charges from the conductive support to the photosensitive layer, lowering of the chargeability of the photosensitive layer can be prevented, decrease of the surface charges at a portion other than the exposed portion can be suppressed to prevent occurrence of defects such as fogging in the images. Further, since a uniform surface can be obtained by covering the defects on the surface of the conductive support, the film-forming property of the photosensitive layer can be improved. Further, since the intermediate layer functions as an adhesive for bonding the conductive support and the photosensitive layer, peeling of the photosensitive layer from the conductive support can be suppressed.

Further, according to the invention, the electrophotographic photoreceptor of the invention excellent in the electric characteristics such as the chargeability, the sensitivity and the light responsiveness, electrical and mechanical durabilities, as well as circumstantial stability is used for the electrophotographic photoreceptor of an image forming apparatus. This makes it possible to attain an image forming apparatus of high reliability capable of forming high quality images stably for a long period of time under various circumstances. Further, since the electrophotographic photoreceptor according to the invention does not lower the picture quality even in a case where it is used in a high speed electrophotographic process, the image forming apparatus of the invention can increase the image forming speed.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
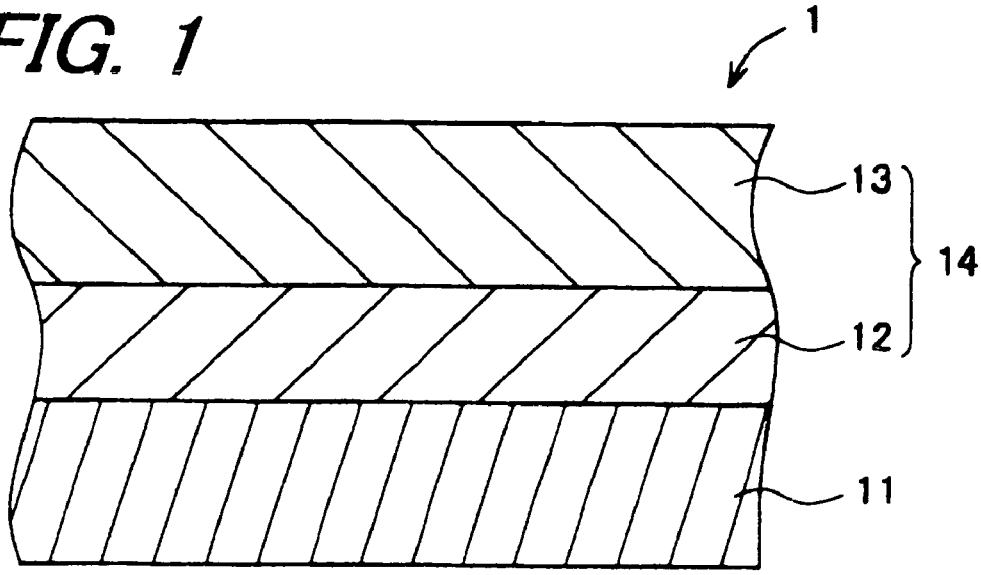
FIG. 1 is a fragmentary cross sectional view schematically showing the constitution of an electrophotographic photoreceptor as a first embodiment of electrophotographic photoreceptor according to the invention.

Now referring to the drawings, preferred embodiments of the invention are described below.

An amine compound of the invention is represented by the following general formula (1):

(1)

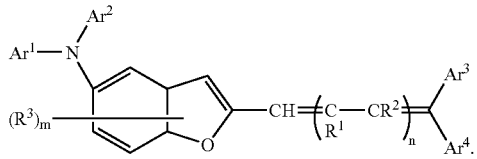

In the general formula (1), $Ar^1$, $Ar^2$, and $Ar^3$ each represent an aryl group which may have a substituent, a heterocycle group which may have a substituent, an aralkyl group which may have a substituent or a thienyl methyl group which may have a substituent; and $Ar^4$ represents a hydrogen atom, an alkyl group which may have a substituent, an aryl group which may have a substituent, a heterocycle group which may have a substituent, or an aralkyl group which may have a substituent. $Ar^3$ and $Ar^4$ may form a ring structure together with a carbon atom bonded thereto. $R^1$ and $R^2$ each represent a hydrogen atom, an alkyl group which may have a substituent, an aryl group which may have a substituent, a heterocycle group which may have a substituent, or an aralkyl group which may have a substituent. n represents an integer of 1 or 2. In a case where n is 2, two $R^1$s may be identical or different, and two $R^2$S may be identical or different. $R^3$ represents an alkyl group of 1 to 3 carbon atoms which may have a substituent, a fluoroalkyl group of 1 to 5 carbon atoms which may have a substituent, a perfluoroalkyl group of 1 to 5 carbon atoms, an alkoxy group of 1 to 3 carbon atoms which may have a substituent, a dialkylamino group of 2 to 8 carbon atoms which may have a substituent, a halogen atom or a hydrogen atom. m represents an integer of 1 to 4. In a case where m is 2 or more, plural $R^3$s may be identical or different.

In the general formula (1), the aryl groups represented by the references $Ar^1$, $Ar^2$ and $Ar^3$ include a phenyl group, naphthyl group, biphenylyl group, terphenyl group, pyrenyl group, anthryl group, etc. Among them, monocyclic or bicyclic aryl groups such as a phenyl group, naphthyl group and biphenylyl group are preferable, a phenyl group being moremore preferable. The substituents which may be possibly present on the aryl groups represented by $Ar^1$, $Ar^2$ and $Ar^3$ include an alkyl group of 1 to 3 carbon atoms such as a methyl group, ethyl group and propyl group; a haloalkyl group of 1 to 5 carbon atoms such as a trifluoromethyl group and monofluoroethyl group; alkenyl group such as a 2-propenyl group and styryl group; an alkoxy group of 1 to 3 carbon atoms such as a methoxy group, ethoxy group and propoxy group; a monoalkyl amino group of 1 to 4 carbon atoms such as a methylamino group and ethylamino group; a dialkylamino group of 2 to 8 carbon atoms such as dimethylamino group, a diethylamino group and diisopropylamino group; a halogen atom such as a fluorine atom, chlorine atom and bromine atom; an aryloxy group such as a phenoxyl group; and an arylthio group such as phenylthio group. Among them, the alkyl groups of 1 to 3 carbon atoms, alkoxy group of 1 to 3 carbon atoms and dialkylamino group of 2 to 8 carbon atoms are preferable, the methyl group, ethyl group, methoxy group, and ethoxy group being more preferable. The aryl groups having a substituent include a tolyl group and methoxyphenyl group. Further, the substituent may form a ring structure together with an aryl group to be bonded thereto, or the aryl groups which the substituent forms a cyclic structure together with include a 5,6,7,8-tetrahydro-1-naphthyl group.

In the general formula (1), the heterocycle groups represented by the references $Ar^1$, $Ar^2$ and $Ar^3$ include a 5-membered or 6-membered condensed ring preferably, 5-membered heterocycle group having, as a heteroatom, an oxygen atom, nitrogen atom, sulfur atom, selenium atom or tellurium atom, preferably, oxygen atom, nitrogen atom or sulfur atom, such as a furyl group, thienyl group, thiazolyl group, benzofuryl group, benzothiophenyl group and carbazolyl group. The substituent that can be present on the heterocycle groups represented by $Ar^1$, $Ar^2$ and $Ar^3$ can include those exemplified above as the substituent which can be present on the aryl groups shown by the references $Ar^1$, $Ar^2$ and $Ar^3$ described above. Among them, an alkyl group of 1 to 3 carbon atoms, an alkoxy group of 1 to 3 carbon atoms and a dialkylamino group of 2 to 8 carbon atoms are preferable, methyl group, ethyl group, methoxy group and ethoxy group being more preferable. The heterocycle groups having a substituent include, for example, an N-methylindolyl group, N-ethylcarbazolyl group, etc.

In the general formula (1), aralkyl groups represented by the references $Ar^1$, $Ar^2$ and $Ar^3$ include an aryl-substituted methyl group such as a benzyl group and 1-naphtylethyl group; and an aryl-substituted ethyl group such as a phenenyl group and 1-naphthylethyl group. Among them, the aryl-substituted methyl group such as a benzyl group or 1-naphthylmethyl group is preferable. The substituent that can be present on the aralkyl group represented by $Ar^1$, $Ar^2$ and $Ar^3$ can include those exemplified as the substituent that can be present on the aryl group represented by the references $Ar^1$, $Ar^2$ and $Ar^3$, and, among them, an alkyl group of 1 to 3 carbon atoms, an alkoxy group of 1 to 3 carbon atoms, and a dialkylamino group of 2 to 8 carbon atoms are preferable and, methyl group or methoxy group being moremore preferable.

In the general formula (1), thienylmethyl groups represented by the references $Ar^1$, $Ar^2$ and $Ar^3$ include a 2-thienylmethyl group, 3-thienylmethyl group, etc. The substituent that can be present on the thienylmethyl group represented by $Ar^1$, $Ar^2$ and $Ar^3$ can include those exemplified as the substituent that can be present on the aryl group represented by the references $Ar^1$, $Ar^2$ and $Ar^3$, and, among them, an alkyl group of 1 to 3 carbon atoms, an alkoxy group of 1 to 3 carbon atoms, and a dialkylamino group of 2 to 8 carbon atoms are preferable, methyl group and methoxy group being moremore preferable.

In the general formula (1), alkyl groups represented by the reference $Ar^4$ include a linear alkyl group such as a methyl group, ethyl group, n-propyl group and n-butyl group; a branched alkyl group such as an isopropyl group and t-butyl group; and a cycloalkyl group such as a cyclohexyl group and cyclopentyl group. Among them, a linear or branched alkyl group of 1 to 4 carbon atoms is more preferable. The substituent that can be present on the alkyl group represented by $Ar^4$ can include, for example, those exemplified as the substituent that can be present on the aryl group represented by the references $Ar^1$, $Ar^2$ and $Ar^3$ and, among them, a halogen atom such as a fluorine atom, chlorine atom and bromine atom is preferable.

In the general formula (1), aryl groups represented by the references $Ar^1$, $Ar^2$ and $Ar^3$ include a phenyl group, naphthyl group, biphenylyl group, terphenyl group, pyrenyl group, anthryl group, etc. Among them, a monocyclic or bicyclic aryl group such as a phenyl group, naphthyl group and biphenylyl group is preferable, the phenyl group being more preferable. The substituent that can be present on the aryl group represented by $Ar^4$ can include, for example, those exemplified as the substituent that can be present on the aryl group represented by the references $Ar^1$, $Ar^2$ and $Ar^3$ and, among them, an alkyl group of 1 to 3 carbon atoms, an alkoxy group of 1 to 3 carbon atoms, and a dialkylamino group of 2 to 8 carbon atoms are preferable, methyl group and methoxy group being more preferable. The aryl groups having the substituent include, for example, a tolyl group and methoxyphenyl group.

In the general formula (1), heterocycle groups represented by the references $Ar^4$ include a 5-membered or 6-membered condensed ring preferably, 5-membered heterocycle group having, as a heteroatom, an oxygen atom, nitrogen atom, sulfur atom, selenium atom or tellurium atom, preferably, oxygen atom, nitrogen atom or sulfur atom, such as a furyl group, thienyl group, thiazolyl group, benzofuryl group, benzothiophenyl group and carbazolyl group. The substituent that can be present on the heterocycle group represented by $Ar^4$ can include those exemplified above as the substituent which can be present on the aryl group shown by the references $Ar^1$ $Ar^2$ and $Ar^3$ described above. Among them, an alkyl group of 1 to 3 carbon atoms, an alkoxy group of 1 to 3 carbon atoms and a dialkylamino group of 2 to 8 carbon atoms are preferable, methyl group and methoxy group being more preferable.

In the general formula (1), aralkyl groups represented by the reference $Ar^4$ include an aryl-substituted methyl group such as a benzyl group and 1-naphtylmethyl group; and an aryl-substituted ethyl group such as a phenethyl group and 1-naphthylethyl group. Among them, the aryl-substituted methyl group such as the benzyl group and 1-naphthylmethyl group are preferable. The substituent that can be present on the aralkyl group represented by $Ar^4$ can include those exemplified as the substituent that can be present on the aryl group represented by the references $Ar^1$, $Ar^2$ and $Ar^3$ and, among them, an alkyl group of 1 to 3 carbon atoms, an alkoxy group of 1 to 3 carbon atoms, and a dialkylamino group of 2 to 8 carbon atoms are preferable, methyl group and methoxy group being more preferable. The aralkyl groups having a substituent include, for example, a p-methoxybenzyl group.

In the general formula (1), ring structures that are formed by $Ar^3$ and $Ar^4$ together with a carbon atom bonded thereto include a condensed ring, preferably, a bicyclic or tricyclic condensed ring such as indane, tetrahydronaphthalene and benzosuberone.

In the general formula (1), alkyl groups represented by the references $R^1$ and $R^2$ include a linear alkyl group such as a methyl group, ethyl group, n-propyl group and n-butyl group; a branched alkyl group such as an isopropyl group and t-butyl group; and a cycloalkyl group such as a cyclohexyl group and cyclopentyl group. Among them, a linear or branched alkyl group of 1 to 4 carbon atoms is more preferable. The substituent that can be present on the alkyl group represented by $Ar^4$ can include, for example, those exemplified as the substituent that can be present on the aryl group represented by the references $Ar^1$, $Ar^2$ and $Ar^3$ and, among them, a halogen atom such as a fluorine atom, chlorine atom and bromine atom is preferable.

In the general formula (1), aryl groups represented by the references $R^1$ and $R^2$ include a phenyl group, naphthyl group, biphenylyl group, terphenyl group, pyrenyl group, anthryl group, etc. Among them, a monocyclic or bicyclic aryl group such as a phenyl group, naphthyl group and biphenylyl group is preferable, the phenyl group being more preferable. The substituents which may be possibly present on the aryl group represented by $Ar^4$ include those exemplified above as the substituent which can be present on the aryl group shown by the references $Ar^1$, $Ar^2$ and $Ar^3$ described above. Among them, an alkyl group of 1 to 3 carbon atoms, an alkoxy group of 1 to 3 carbon atoms, and a dialkylamino group of 2 to 8 carbon atoms are preferable, methyl group and methoxy group being more preferable. The aryl groups having the substituent include, for example, a tolyl group and methoxyphenyl group.

In the general formula (1), the heterocycle groups represented by the references $R^1$ and $R^2$ include a 5-membered or 6-membered condensed ring preferably, 5-membered heterocycle group having, as a heteroatom, an oxygen atom, nitrogen atom, sulfur atom, selenium atom or tellurium atom, preferably, oxygen atom, nitrogen atom or sulfur atom, for example, a furyl group, thienyl group, thiazolyl group, benzofuryl group, benzothiophenyl group and carbazolyl group. The substituent that can be present on the heterocycle group represented by $Ar^4$ can include those exemplified above as the substituent which can be present on the aryl group shown by the references $Ar^1$, $Ar^2$ and $Ar^3$ described above. Among them, an alkyl group of 1 to 3 carbon atoms, an alkoxy group of 1 to 3 carbon atoms and a dialkylamino group of 2 to 8 carbon atoms are preferable, methyl group and methoxy group being more preferable.

In the general formula (1), aralkyl groups represented by the references R and $R^2$ include an aryl-substituted methyl group such as a benzyl group and 1-naphtylethyl group; an aryl-substituted ethyl group such as a phenethyl group and 1-naphthylethyl group. Among them, the aryl-substituted methyl group such as a benzyl group or 1-naphthylmethyl group is preferable. The substituent that can be present on the aralkyl group represented by $Ar^4$ can include those exemplified as the substituent that can be present on the aryl group represented by the references $Ar^1$, $Ar^2$ and $Ar^3$, and, among them, an alkyl group of 1 to 3 carbon atoms, an alkoxy group of 1 to 3 carbon atoms, and a dialkylamino group of 2 to 8 carbon atoms are preferable, methyl group and methoxy group being more preferable. The aralkyl groups having the substituent include, for example, a p-methoxybenzyl group.

In the general formula (1), alkyl groups of 1 to 3 carbon atoms represented by the reference $R^3$ include, for example, linear alkyl groups of 1 to 3 carbon atoms such as a methyl group, ethyl group and n-propyl group; and branched alkyl groups of 1 to 3 carbon atoms such as an isopropyl group. The substituents that can be present on the alkyl group represented by $R^3$ include those exemplified as the substituent that can be present on the aryl group represented by the references $Ar^1$, $Ar^2$ and $Ar^3$.

In the general formula (1), fluoroalkyl groups of 1 to 5 carbon atoms represented by the reference $R^3$ include linear or branched monofluoroalkyl groups of 1 to 5 carbon atoms such as monofluoromethyl group and 1-monofluoroethyl group; linear or branched difluoroalkyl groups of 1 to 5 carbon atoms such as a 1,1-difluroethyl group and 1,1-difluoropropyl group; and linear or branched trifluoroalkyl groups of 1 to 5 carbon atoms such as a 1,1,1-trifluorobutyl group and 1,1,1-trifluoropentyl group. The substituents that can be present on the fluoroalkyl group of 1 to 5 carbon atoms represented by $R^3$ can include those, for example, exemplified as the substituent that can be present on the aryl group represented by the references $Ar^1$, $Ar^2$ and $Ar^3$.

In the general formula (I), the perfluoroalkyl groups of 1 to 5 carbon atoms represented by the reference $R^3$ include, for example, linear or branched perfluoroalkyl groups of 1 to 5 carbon atoms such as trifluoromethyl group, pentafluoromethyl group and heptafluoropropyl group.

In the general formula (1), alkoxy groups of 1 to 3 carbon atoms represented by the reference $R^3$ include, for example, a linear alkoxy group of 1 to 3 carbon atoms such as a methoxy group, ethoxy group and n-propoxy group; and a branched alkoxy group of 1 to 3 carbon atoms such as an isopropoxy group. The substituent that can be present on the alkoxy group of 1 to 3 carbon atoms represented by $R^3$ can include, for example, those exemplified as the substituent that can be present on the aryl group represented by the reference $Ar^1$, $Ar^2$ and $Ar^3$.

In the general formula (1), dialkylamino groups of 2 to 8 carbon atoms represented by the reference $R^3$ include, for example, a symmetrical dialkylamino group of 2 to 8 carbon atoms such as a dimethylamino group, diethylamino group and diisopropylamino group; and an asymmetric dialkylamino group of 2 to 8 carbon atoms such as an ethylmethlamino group and isopropylethylamino group. Among them, the symmetric dialkylamino group of 2 to 8 carbon atoms is preferable. The substituent that can be present on the dialkylamino group of 2 to 8 carbon atoms represented by $R^3$ can include, for example, those exemplified as the substituent that can be present on the aryl group represented by the references $Ar^1$, $Ar^2$ and $Ar^3$. The substituents substitute the alkyl moiety of the dialkylamino group of 2 to 8 carbon atoms, and the dialkylamino group of 2 to 8 carbon atoms having the substituent include, for example, a dialkylamino group of 2 to 8 carbon atoms having the substituent on the alkyl moiety such as a bis(2-chlroethyl)amino group and 2-chloroethylmethylamino group.

In the general formula (1), the halogen atom represented by the reference $R^3$ include a fluorine atom, chlorine atom and bromine atom and, among them, the fluorine atom and chlorine atom are preferable.

Since the amine compound of the invention represented by the general formula (1) is excellent in the charge transportability, particularly, the hole transportability, it can be used suitably as the charge-transporting substance. For example, a device of excellent responsiveness can be provided by using the amine compound of the invention represented by the general formula (1) as a charge-transporting substance for the devices such as an electrostatic recording device of an electrophotographic photoreceptor, etc., a sensor, or an EL device. Particularly, when the amine compound of the invention is incorporated as a charge-transporting substance in a photosensitive layer of an electrophotographic photoreceptor, it is made possible to attain an electrophotographic photoreceptor of high reliability, satisfactory in electric characteristics such as chargeability, sensitivity and light responsiveness, excellent in electrical and mechanical durabilies and circumstantial stability and capable of providing high quality images stably for a long period of time in various circumstances.

Among the amine compounds of the invention represented by the general formula (1), the compound particularly excellent in view of the production cost, the productivity, etc. include an amine compound with n=1 in the general formula (1), that is, the amine compound represented by the following general formula (1a):

(1a)

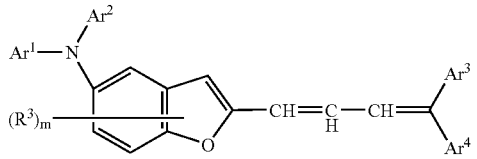

In the general formula (1a), $Ar^1$, $Ar^2$ $Ar^3$, $Ar^4$ and $R^3$ and m have the same meanings as defined in the general formula (1).

Since the amine compound represented by the formula (1a) has a benzofuran amide-diene structure which can be synthesized relatively easily, it shows high synthesis yield and can be provided at a relatively reduced cost. Accordingly, by using the amine compound represented by the general formula (1a) for devices such as an electrostatic recording device of an electrophotographic photoreceptor, etc., a sensor or an EL device, the production cost of the devices can be reduced.

Further, among the amine compounds represented by the general formula (1a), the amine compound represented by the following general formula (2) is further preferable.

(2)

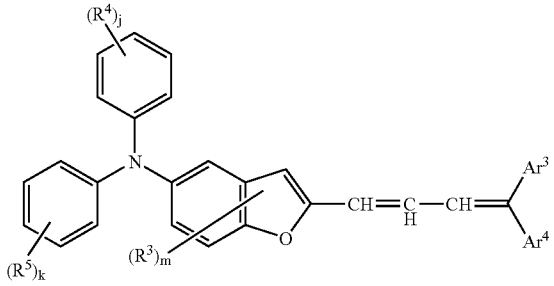

In the general formula (2), $R^4$ and $R^5$ each represent an alkyl group of 1 to 3 carbon atoms which may have a substituent, a fluoroalkyl group of 1 to 5 carbon atoms which may have a substituent, a perfluoroalkyl group of 1 to 5 carbon atoms, an alkoxy group of 1 to 3 carbon atoms which may have a substituent, a dialkylamino group of 2 to 8 carbon atoms which may have a substituent, a halogen atom or a hydrogen atom, respectively. j and k each represent an integer of from 1 to 5. In a case where j is 2 or more, plural $R^4$ may be identical or different. In a case where k is 2 or more, plural $R^5$ may be identical or different. $Ar^3$, $Ar^4$ and $R^3$ and m have the same meanings as defined in the general formula (1).

In the general formula (2), the alkyl groups of 1 to 3 carbon atoms represented by the references $R^4$ and $R^5$ include, for example, a linear alkyl group of 1 to 3 carbon atoms such as a methyl group, ethyl group and n-propyl group; and a branched alkyl group of 1 to 3 carbon atoms such as an isopropyl group. The substituents that can be present on the alkyl group represented by $R^4$ and $R^5$ can include, for example, those exemplified as the substituent that can be present on the aryl group represented by the references $Ar^1$, $Ar^2$ and $Ar^3$.

In the general formula (2), the fluoroalkyl group of 1 to 5 carbon atoms represented by the references $R^4$ and $R^5$ include, for example, a linear or branched monofluoroalkyl group of 1 to 5 carbon atoms such as a monofluoromethyl group and 1-monofluoroethyl group; a linear or branched difluoroalkyl group of 1 to 5 carbon atoms such as a 1,1-difluoroethyl group and 1,1-difluoropropyl group; and a linear or branched trifluoroalkyl group of 1 to 5 carbon atoms such as a 1,1,1-trifluorobutyl group and 1,1,1-trifluoropentyl group. The substituent that can be present on the fluoroalkyl group of 1 to 5 carbon atoms represented by $R^4$ and $R^5$ can include, for example, those exemplified as the substituent that can be present on the aryl group represented by the references $Ar^1$, $Ar^2$ and $Ar^3$.

In the general formula (2), the perfluoroalkyl groups of 1 to 5 carbon atoms represented by the references $R^4$ and $R^5$ include, for example, a linear or branched perfluoroalkyl group of 1 to 5 carbon atoms such as a trifluoromethyl group, pentafluoroethyl group, and heptafluoropropyl group.

In the general formula (2), the alkoxy groups of 1 to 3 carbon atoms represented by the references $R^4$ and $R^5$ include, for example, a linear alkoxy group of 1 to 3 carbon atoms such as a methoxy group, ethoxy group, and n-propoxy group; and a branched alkoxy group of 1 to 3 carbon atoms such as an isopropoxy group. The substituent that can be present on the alkoxy group of 1 to 3 carbon atoms represented by $R^4$ and $R^5$ can include, for example, those exemplified as the substituent that can be present on the aryl group represented by the references $Ar^1$, $Ar^2$ and $Ar^3$.

In the general formula (2), the dialkylamino groups of 2 to 8 carbon atoms represented by the references $R^4$ and $R^5$ include, for example, a symmetric dialkylamino group of 2 to 8 carbon atoms such as a dimethylamino group, diethylamino group and diisopropylamino group; and an asymmetric dialkylamino group of 2 to 8 carbon atoms such as an ethylmethylamino group and isopropylethyl amino group. Among them, the symmetric dialkylamino group of 2 to 8 carbon atoms is preferable. The substituent that can be present on the dialkylamino group of 2 to 8 carbon atoms represented by $R^4$ and $R^5$ can include, for example, those exemplified as the substituent that can be present on the aryl group represented by the references $Ar^1$, $Ar^2$ and $Ar^3$. The substituents substitute the alkyl moiety of the dialkylamino group of 2 to 8 carbon atoms, and the dialkylamino groups of 2 to 8 carbon atoms having the substituent include, for example, a dialkylamino group of 2 to 8 carbon atoms having the substituent on the alkyl moiety such as a bis(2-chloroethyl)amino group and 2-chloroethylmethylamino group.

In the general formula (2), the halogen atoms represented by the references $R^4$ and $R^5$ include, for example, a fluorine atom, chlorine atom and bromine atom and, among them, the fluorine atom and the chlorine atom are preferable.

Since the amine compound represented by the general formula (2) has an N,N-diphenylbenzofuranamine-diene structure which can be synthesized particularly easily, it can be produced at a further reduced cost than the amine compound represented by the general formula (1a). Accordingly, by using the amine compound represented by the general formula (2) for devices such as an electrostatic recording device of an electrophotographic photoreceptor, etc., a sensor or an EL device, the production cost of the devices can be further reduced.

Among the amine compounds represented by the general formula (1), particularly excellent compounds in view of the characteristics such as the charge transportability include amine compounds of the general formula (1), where $Ar^1$ and $Ar^2$ each represent a phenyl group or a phenyl group substituted with an alkyl group of 1 to 3 carbon atoms or an alkoxy group of 1 to 3 carbon atoms; $Ar^3$ represents a phenyl group or a phenyl group substituted with an alkyl group of 1 to 3 carbon atoms, an alkoxy group of 1 to 3 carbon atoms or a styryl group; $Ar^4$ represents a hydrogen atom, an alkyl group of 1 to 3 carbon atoms, a phenyl group, a phenyl group substituted with an alkyl group of 1 to 3 carbon atoms; $R^1$ and $R^2$ each represent a hydrogen atom or an alkyl group of 1 to 3 carbon atoms, respectively; and $R^3$ represents a hydrogen atom, an alkyl group of 1 to 3 carbon atoms, an alkoxy group of 1 to 3 carbon atoms or a fluoroalkyl group of 1 to 3 carbon atoms.

Among them, in view of the production cost and the productivity, those included in the amine compound represented by the general formula (1a) are preferable. Those included in the amine compound represented by the general formula (2) are further preferable, and amine compounds included in the amine compound represented by the general formula (2) in which $Ar^1$, $Ar^2$ and $Ar^3$ each represent a phenyl group, p-tolyl group or p-methoxyphenyl group; $Ar^4$ represents a hydrogen atom, a methyl group, phenyl group or p-tolyl group; each of $R^1$ and $R^2$ and $R^3$ is a hydrogen atom; and n is 1, in the general formula (1) are more preferable.

Specific examples of the amine compound represented by the general formula (1) can include, for example, Exemplified Compounds No. 1 to No. 70 shown in the following Table 1 to Table 7 but the amine compound of the invention is not restricted to them. In Table 1 to Table 7, each of the exemplified compounds is indicated by the group corresponding to each group of the general formula (1). For example, the Exemplified Compound No. 1 shown in Table 1 is an amine compound represented by the following structural formula (3). However, in the general formula (1), in a case of illustrating an amine compound in which a ring structure is formed by $Ar^3$ and $Ar^4$ together with the carbon atom bonded thereto, the ring structure formed by $Ar^3$ and $Ar^4$ together with the carbon atom bonded thereto and the carbon-carbon double bonded with $Ar^3$ and $Ar^4$ are shown from the column for $Ar^3$ to the column for $Ar^4$. Further, in a case of illustrating those where the groups represented by two $R^1$s are identical and the groups represented by two $R^2$s are identical among the amine compounds at n=2 in the general formula (1), $R^1$ and $R^2$ are represented each by one. Further, in Table 1 to Table 7, n-$C_3H_7$ shows an n-propyl group and n-$CH_4H_8$ means an n-butylene group.

TABLE 1
(3)
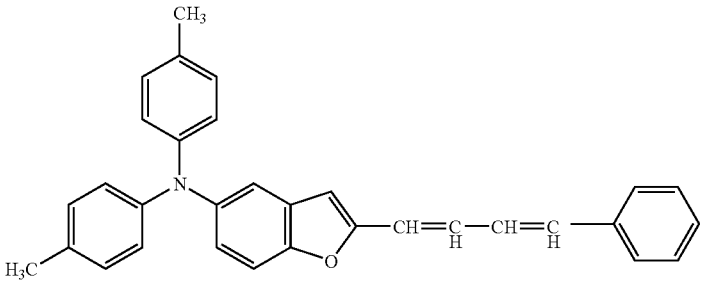
| Compound | $Ar^1$ | $Ar^2$ | 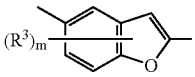 | n | CR–$CR^2$ | $Ar^3$ | $Ar^4$ |
|---|---|---|---|---|---|---|---|
| 1 | 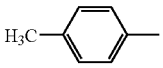 | 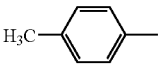 | 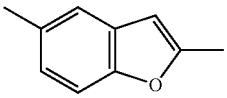 | 1 | CH—CH | 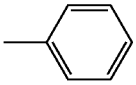 | H |
| 2 | 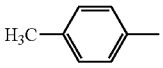 | 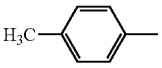 | 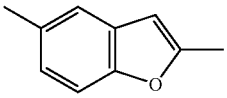 | 1 | CH—CH | 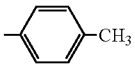 | H |
| 3 | 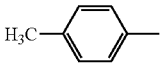 | 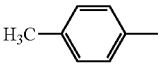 | 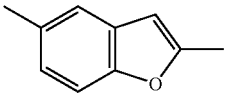 | 1 | CH—CH | 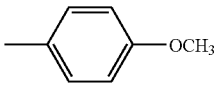 | H |
| 4 | 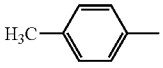 | 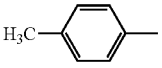 | 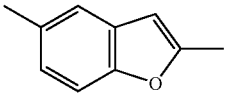 | 1 | CH—CH | 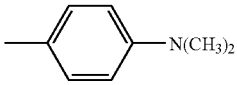 | H |
| 5 | 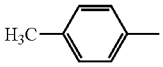 | 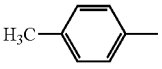 | 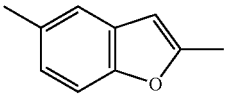 | 1 | CH—CH | 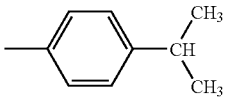 | H |
| 6 | 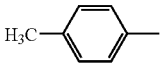 | 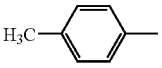 | 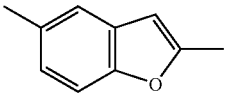 | 1 | CH—CH | 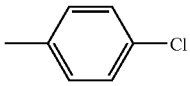 | —$CH_3$ |
| 7 | 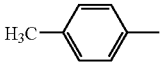 | 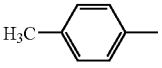 | 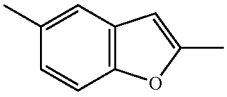 | 1 | CH—CH | 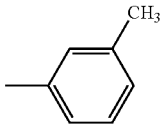 | H |
| 8 | 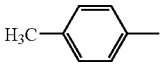 | 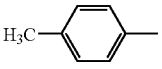 | 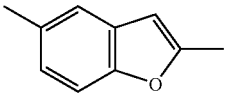 | 1 | CH—CH | 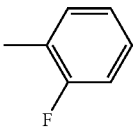 | —$CH_3$ |
| 9 | 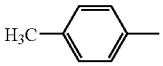 | 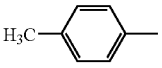 | 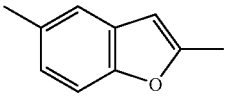 | 1 | CH—CH | 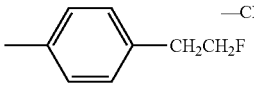 | —$CH_3$ |

TABLE 1-continued
(3)
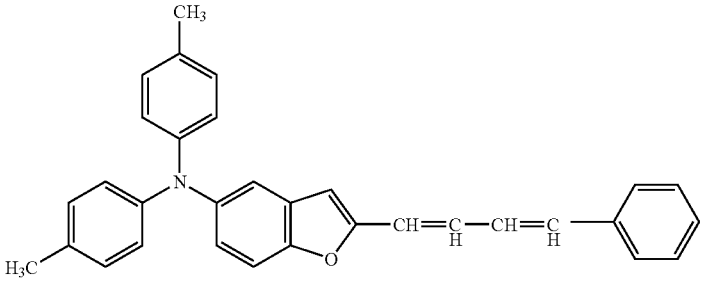
| Compound | $Ar^1$ | $Ar^2$ | 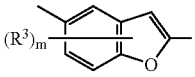 | n | $CR–CR^2$ | $Ar^3$ | $Ar^4$ |
|---|---|---|---|---|---|---|---|
| 10 | 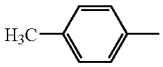 | 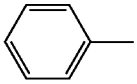 | 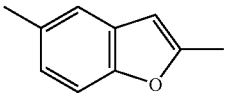 | 1 | CH—CH | 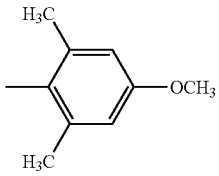 | H |
| 11 | 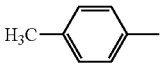 | 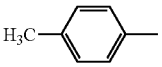 | 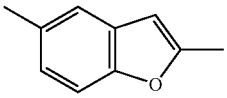 | 1 | CH—CH | 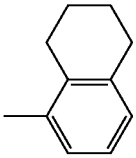 | H |
| 12 | 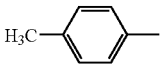 | 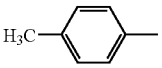 | 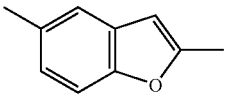 | 1 | CH—CH | 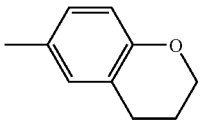 | H |
| 13 | 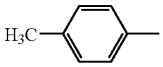 | 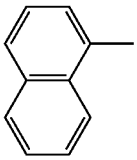 | 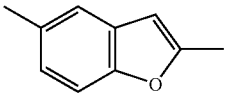 | 1 | CH—CH | 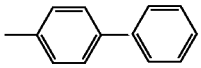 | H |
| 14 | 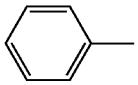 | 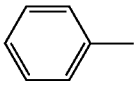 | 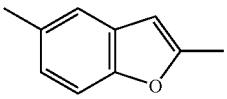 | 1 | CH—CH | 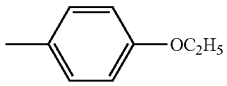 | H |
TABLE 2
| Compound No. | $Ar^1$ | $Ar^2$ | 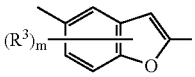 | n | $CR^1–CR^2$ | $Ar^3$ | $Ar^4$ |
|---|---|---|---|---|---|---|---|
| 15 | 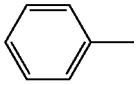 | 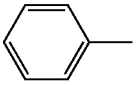 | 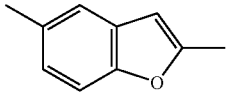 | 1 | CH—CH | 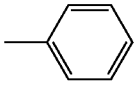 | 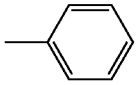 |
| 16 | 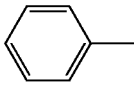 | 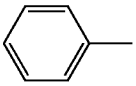 | 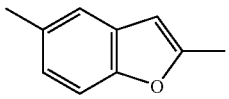 | 1 | CH—CH | 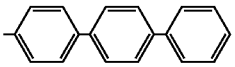 | $—CH_3$ |

TABLE 2-continued
| Compound No. | $Ar^1$ | $Ar^2$ | $(R^3)_m$ | n | $CR^1$–$CR^2$ | $Ar^3$ | $Ar^4$ |
|---|---|---|---|---|---|---|---|
| 17 | 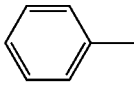 | 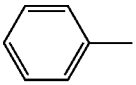 | 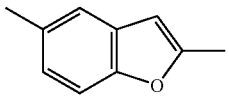 | 1 | CH—CH | 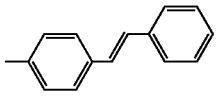 | H |
| 18 | 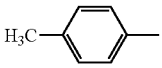 | 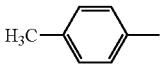 | 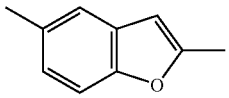 | 1 | CH—CH | 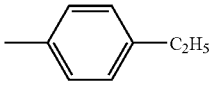 | H |
| 19 | 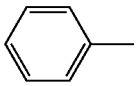 | 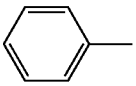 | 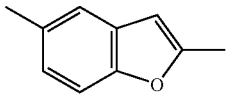 | 1 | CH—CH | 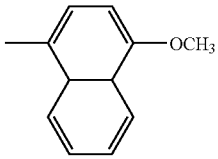 | H |
| 20 | 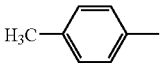 | 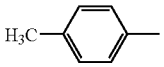 | 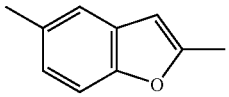 | 1 | CH—CH | 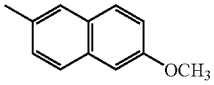 | H |
| 21 | 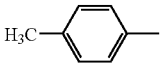 | 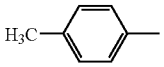 | 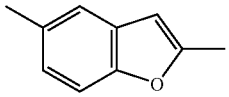 | 1 | CH—CH | 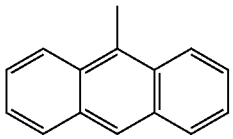 | H |
| 22 | 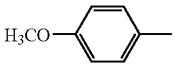 | 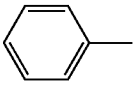 | 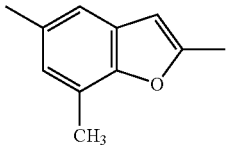 | 1 | CH—CH | 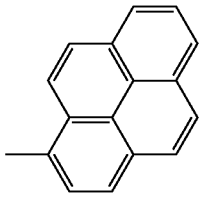 | H |
| 23 | 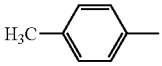 | 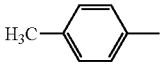 | 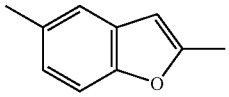 | 2 | CH—CH | 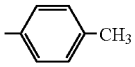 | 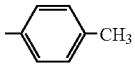 |
| 24 | 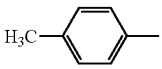 | 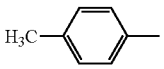 | 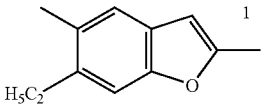 | 1 | CH—CH | 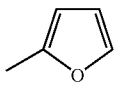 | $—CH_3$ |
| 25 | 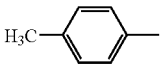 | 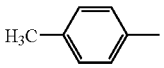 | 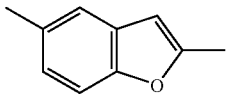 | 2 | CH—CH | 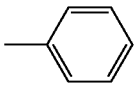 | H |
| 26 | 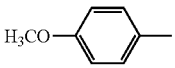 | 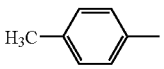 | 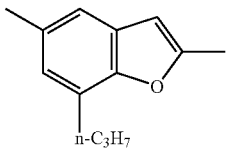 | 1 | CH—CH | 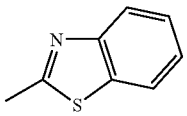 | H |

TABLE 3

| Compound No. | $Ar^1$ | $Ar^2$ | $(R^3)_m$ | n | $CR^1$–$CR^2$ | $Ar^3$ | $Ar^4$ |
|---|---|---|---|---|---|---|---|
| 27 | $H_3C$ | $H_3C$ | $CH_2CF_3$ | 1 | CH—CH | N, $C_2H_5$ | H |
| 28 | $H_3C$ | $H_3C$ | $CF_3$ | 2 | CH—CH | | |
| 29 | $H_3C$ | $H_3C$ | $C_2F_5$ | 2 | CH—CH | $CH_3$ | $CH_3$ |
| 30 | $H_3C$ | $H_3C$ | n-$C_4H_8CF_3$ | 2 | CH—CH | $OCH_3$ | $OCH_3$ |
| 31 | $H_3C$ | $H_3C$ | $F_3C$–CH–$CF_3$ | 2 | CH—CH | $N(CH_3)_2$ | $N(CH_3)_2$ |
| 32 | $H_3C$ | $H_3C$ | $OCH_3$ | 1 | CH—CH | | |
| 33 | | | New GET,1261 | 1 | CH—CH | S | |

TABLE 4

| Compound No. | $Ar^1$ | $Ar^2$ | $(R^3)_m$ | n | $CR^1$–$CR^2$ | $Ar^3$ | $Ar^4$ |
|---|---|---|---|---|---|---|---|
| 34 | | | $OCH(CH_3)_2$ | 1 | CH—CH | | |

TABLE 4-continued
| Compound No. | $Ar^1$ | $Ar^2$ | 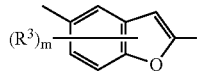 | n | $CR^1$–$CR^2$ | $Ar^3$ | $Ar^4$ |
|---|---|---|---|---|---|---|---|
| 35 | 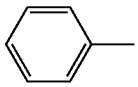 | 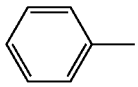 | 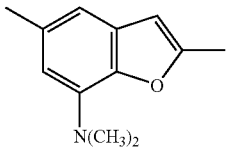 | 1 | CH—CH | 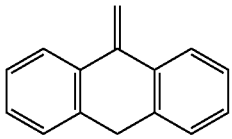 | |
| 36 | 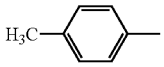 | 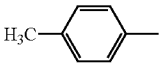 | 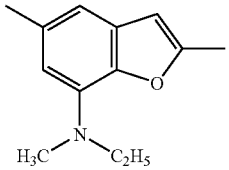 | 1 | CH—CH | 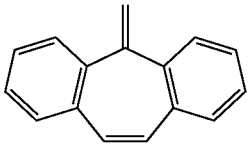 | |
| 37 | 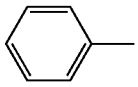 | 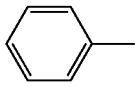 | 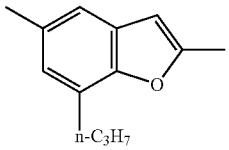 | 1 | CH—CH | 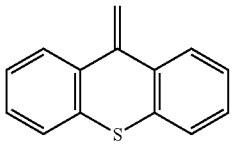 | |
| 38 | 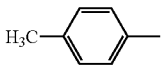 | 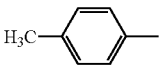 | 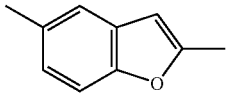 | 2 | CH—CH | 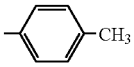 | H |
| 39 | 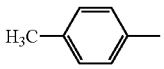 | 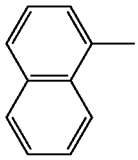 | 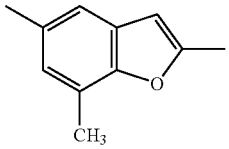 | 1 | CH—CH | 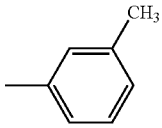 | H |
| 40 | 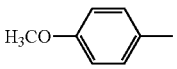 | 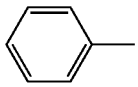 | 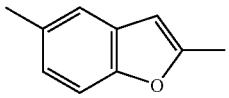 | 1 | CH—CH | 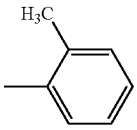 | H |
| 41 | 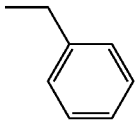 | 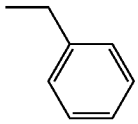 | 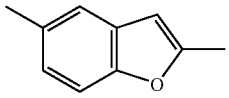 | 1 | CH—CH | 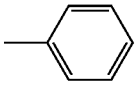 | H |
| 42 | 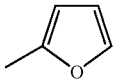 | 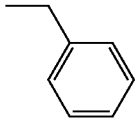 | 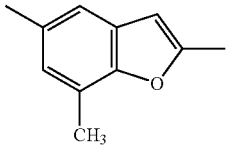 | 1 | 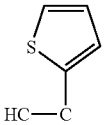 | 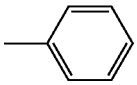 | H |
| 43 | 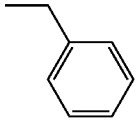 | 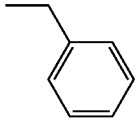 | 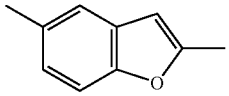 | 1 | 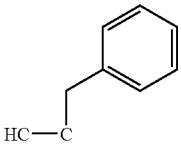 | 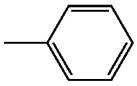 | H |

TABLE 5
| Compound No. | $Ar^1$ | $Ar^2$ | 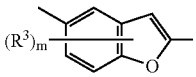 | n | $CR^1$–$CR^2$ | $Ar^3$ | $Ar^4$ |
|---|---|---|---|---|---|---|---|
| 44 | 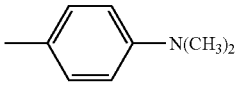 | 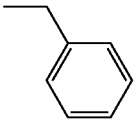 | 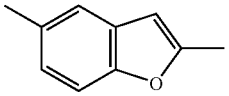 | 1 | 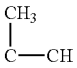 | 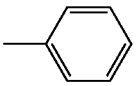 | H |
| 45 | 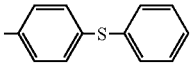 | 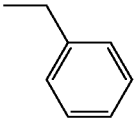 | 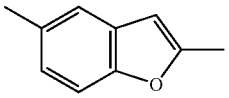 | 1 | 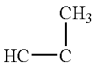 | 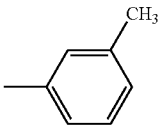 | H |
| 46 | 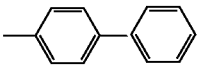 | 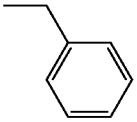 | 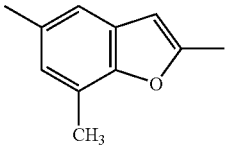 | 2 | 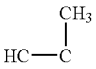 | 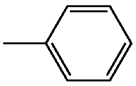 | H |
| 47 | 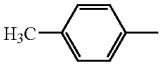 | 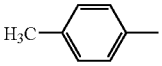 | 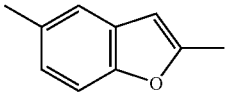 | 2 | 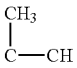 | 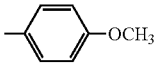 | H |
| 48 | 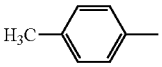 | 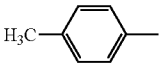 | 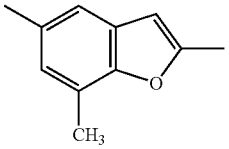 | 2 | 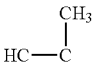 | 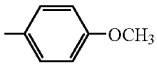 | —$CH_3$ |
| 49 | 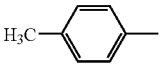 | 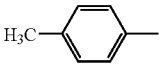 | 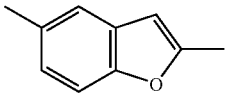 | 2 | 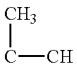 | 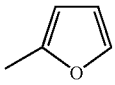 | —$CH_3$ |
| 50 | 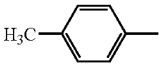 | 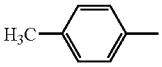 | 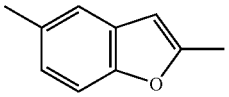 | 1 | 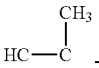 | 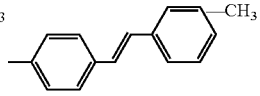 | —$CH_3$ |
| 51 | 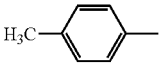 | 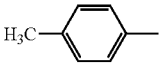 | 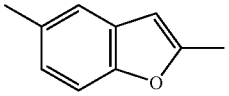 | 2 | 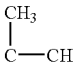 | 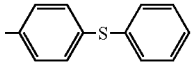 | —$CH_3$ |
| 52 | 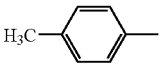 | 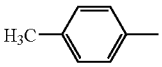 | 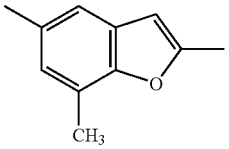 | 2 | 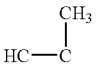 | 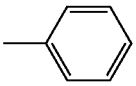 | H |
| 53 | 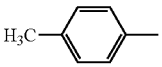 | 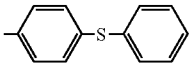 | 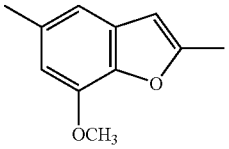 | 2 | 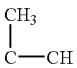 | 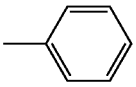 | H |
| 54 | 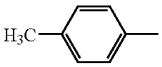 | 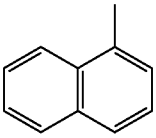 | 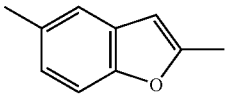 | 2 | 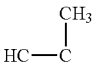 | 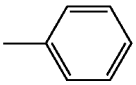 | H |

TABLE 5-continued
| | | | | | | |
|---|---|---|---|---|---|---|
| 55 | 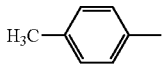 | 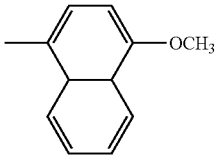 | 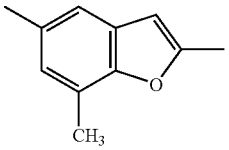 | 1 | 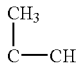 | 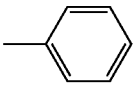 | H |
TABLE 6
| Compound No. | $Ar^1$ | $Ar^2$ | 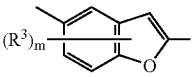 | n | $CR^1$–$CR^2$ | $Ar^3$ | $Ar^4$ |
|---|---|---|---|---|---|---|---|
| 56 | 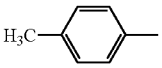 | 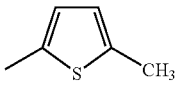 | 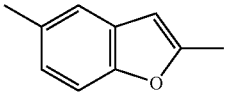 | 2 | 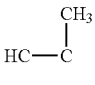 | 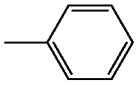 | H |
| 57 | 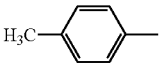 | 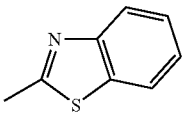 | 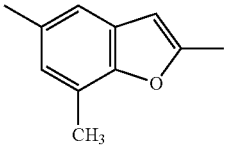 | 2 | 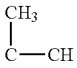 | 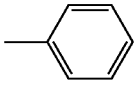 | H |
| 58 | 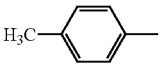 | 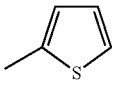 | 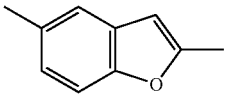 | 2 | 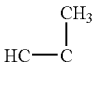 | 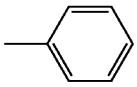 | H |
| 59 | 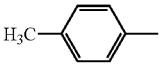 | 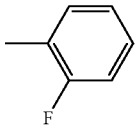 | 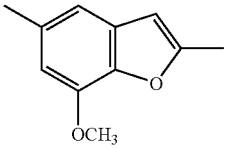 | 2 | 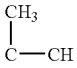 | 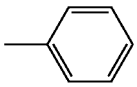 | H |
| 60 | 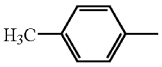 | 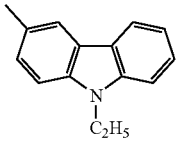 | 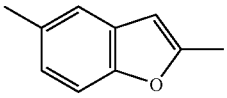 | 2 | 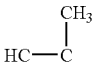 | 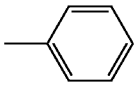 | H |
| 61 | 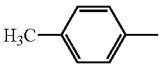 | 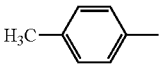 | 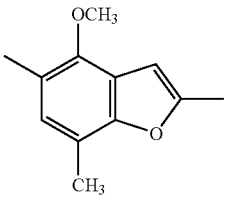 | 1 | CH—CH | 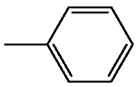 | H |
| 62 | 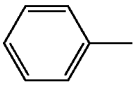 | 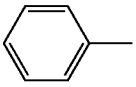 | 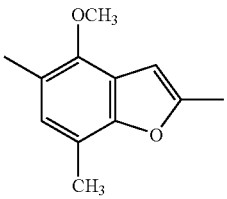 | 1 | CH—CH | 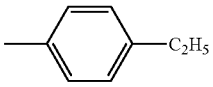 | H |

TABLE 6-continued
| Compound No. | $Ar^1$ | $Ar^2$ | 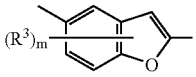 | n | $CR^1$–$CR^2$ | $Ar^3$ | $Ar^4$ |
|---|---|---|---|---|---|---|---|
| 63 | 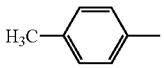 | 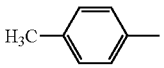 | 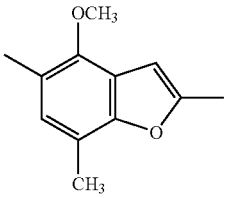 | 1 | CH—CH | 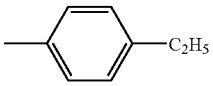 | H |
| 64 | 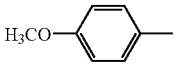 | 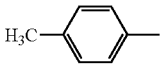 | 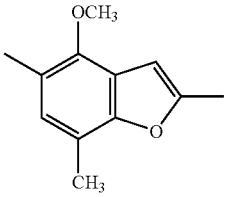 | 2 | CH—CH | 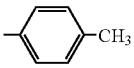 | 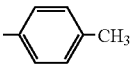 |
| 65 | 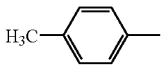 | 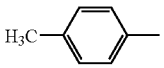 | 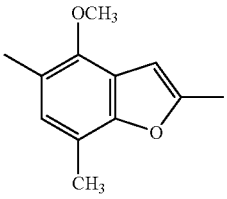 | 1 | CH—CH | 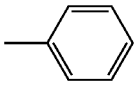 | H |
TABLE 7
| Compound No. | $Ar^1$ | $Ar^2$ | 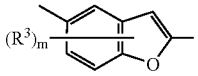 | n | $CR^1$–$CR^2$ | $Ar^3$ | $Ar^4$ |
|---|---|---|---|---|---|---|---|
| 66 | 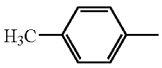 | 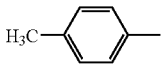 | 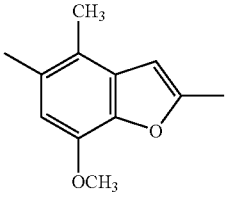 | 2 | CH—CH | 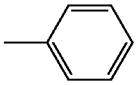 | H |
| 67 | 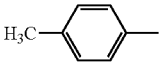 | 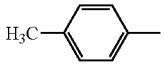 | 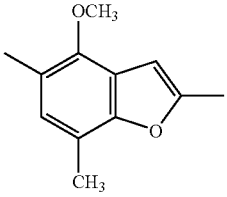 | 2 | CH—CH | 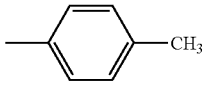 | H |
| 68 | 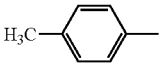 | 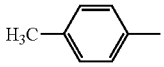 | 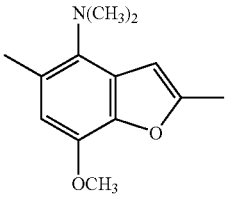 | 1 | CH—CH | 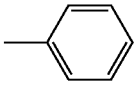 | H |

TABLE 7-continued

| Compound No. | $Ar^1$ | $Ar^2$ | 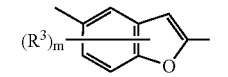 | n | $CR^1$–$CR^2$ | $Ar^3$ | $Ar^4$ |
|---|---|---|---|---|---|---|---|
| 69 | 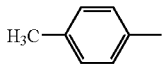 | 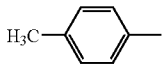 | 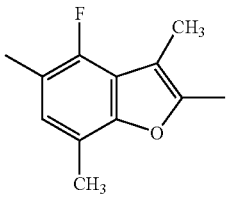 | 1 | CH—CH | 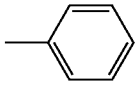 | H |
| 70 | 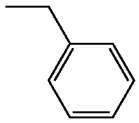 | 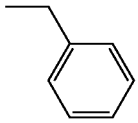 | 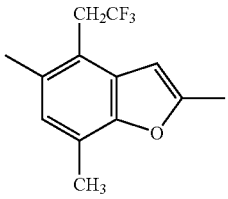 | 1 | CH—CH | 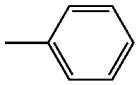 | H |

The amine compound of the invention represented by the general formula (1) can be prepared by utilizing known reaction, and can be produced, for example, by formylating a benzofuran amine compound represented by the following general formula (4):

(4)

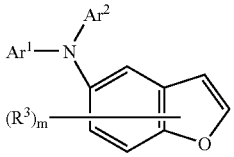

in which $Ar^1$, $Ar^2$, $R^3$ and m have the same meanings as those defined for the general formula (1), thereby synthesizing an amine-aldehyde intermediate product represented by the general formula (5):

(5)

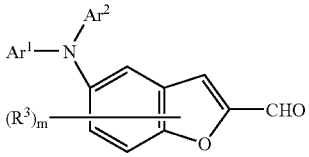

in which $Ar^1$, $Ar^2$, $R^3$ and m have the same meanings as those defined for the general formula (1), and by conducting Wittig-Horner reaction of reacting under the basic condition the obtained amine-aldehyde intermediate product represented by the general formula (5) and a Wittig reagent represented by the following general formula (6):

(6)

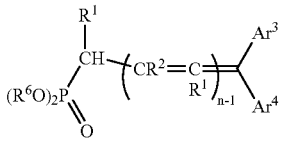

in which $R^6$ represents an alkyl group of 1 to 3 carbon atoms or an aryl group and $Ar^3$, $Ar^4$, $R^1$, $R^2$ and n have the same meanings as those defined in the general formula (1).

In the general formula (6), the alkyl groups of 1 to 3 carbon atoms shown by the reference $R^6$ include a linear alkyl group of 1 to 3 carbon atoms such as a methyl group, ethyl group and n-propyl group; a branched alkyl group of 1 to 3 carbon atoms such as an isopropyl group. Among them, the ethyl group and isopropyl group are preferable. Further, the aryl groups represented by the reference $R^6$ include a monocyclic or bicyclic aryl group such as a phenyl group, naphthyl group and biphenyl group and, among them, the phenyl group is preferable.

The formylation of the benzofuran amine compound represented by the general formula (4) can be conducted by using, a known formylating reaction such as Vilsmeier reaction. In a case of using the Vilsmeier reaction, the benzofuran amine compound represented by the general formula (4) can be formylated, for example, as described below. At first, phosphorus oxychloride, phosgene or thienyl chloride and N,N-dimethyl formamide (simply referred to as DMF), N-methyl-N-phenylformamide or N,N-diphenylformamide are added to an appropriate solvent, to prepare a Vilsmeier reagent. The solvent used can include, for example, an aprotic polar solvent such as N,N-dimethylformamide and a halogenated hydrocarbon such as 1,2-dichloroethane.

Then, 1.0 molar amount of the benzofuran amine compound represented by the general formula (4) is added to a solution containing 1.0 to 1.3 molar amount of the prepared Vilsmeier reagent and reacted by stirring for 2 to 8 hours while keeping the temperature of the reaction solution in a range of 60 to 110° C. After the completion of the reaction, hydrolysis is conducted with an aqueous alkaline solution such as an aqueous solution of sodium hydroxide or aqueous solution of potassium hydroxide of 1 to 8N concentration. This makes it possible to prepare the amine-aldehyde intermediate product represented by the general formula (5) at a high yield.

While the benzofuran amine compound represented by the general formula (4) is available as a commercial product but it may be prepared, for example, also by Ullmann reaction of a 5-halobenzofuran compound represented by the following general formula (4a):

(4a)

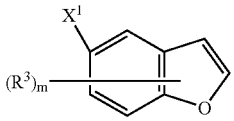

in which $X^1$ represents a halogen atom and $R^3$ and m have the same meanings as those described in the general formula (1), and a secondary amine compound represented by the following general formula (4b):

(4b)

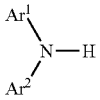

in which $Ar^1$ and $Ar^2$ have the same meanings as those defined in general formula (1).

In the general formula (4a), the halogen atoms represented by the reference $X^1$ include a fluorine atom, chlorine atom, bromine atom, iodine atom, etc. and, among them, the iodine atom and bromine atom are preferable.

The Ullmann reaction of the 5-halobenzofuran compound represented by the general formula (4a) and the secondary amine compound represented by the general formula (4b) is conducted as described below. For example, 1.0 to 1.2 molar amount of the 5-halobenzofuran compound represented by the general formula (4a), 1.2 to 1.4 molar amount of the secondary amine compound represented by the general formula (4b), 2.0 to 4.0 molar amount of a copper powder, and, optionally, 2.0 to 4.0 molar amount of anhydrous potassium carbonate and 0.1 to 0.2 molar amount of 18-crown-6 are added to an appropriate solvent such as a halogenated aromatic hydrocarbons such as chlorobenzene and o-dichlorobenzene, and reacted by stirring under heating. This makes it possible to provide the benzofuran amine compound represented by the general formula (4) at a high yield.

The Wittig-Horner reaction of reacting the amine-aldehyde intermediate product represented by the general formula (5) and the Wittig reagent represented by the following general formula (6) is conducted as described below. For example, 1.0 molar amount of the amine-aldehyde intermediate product represented by the general formula (5), 1.0 to 2.2 molar amount of the Wittig reagent represented by the general formula (6), and 1.0 to 2.4 molar amount of a metal alkoxide base are added to an appropriate solvent and stirred for 2 to 8 hours under a room temperature or under heating at 30 to 60° C. This makes it possible to produce the amine compound of the invention represented by the general formula (1) at a high yield.

The solvents used in the Wittig-Horner reaction include aromatic hydrocarbons such as toluene and xylene, ethers such as diethylether, tetrahydrofuran (simply referred to as THF) and ethylene glycol dimethyl ether; and aprotic polar solvents such as N,N-dimethylformamide and dimethyl sulfoxide. The metal alkoxide bases include, for example, potassium t-butoxide, sodium etoxide and sodium methoxide.

While the Wittig reagent represented by the general formula (6) is available as a commercial product, it can be produced also by mixing a trialkyl phosphite or triaryl phosphite represented by the following general formula (6a):

$$(R^6O)_3P \quad (6a)$$

(in which $R^6$ has the same meanings as those defined in the general formula (6)) and an allyl halide of the following general formula (6b):

(6b)

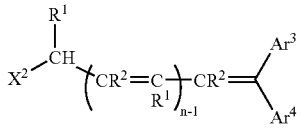

(in which $X^2$ represents a halogen atom, and $Ar^3$, $Ar^4$, $R^1$, $R^2$ and n have the same meanings as those defined in the general formula (1)) each approximately in an equimolar amount with no solvent, and reacting them by stirring under heating.

As the trialkyl phosphite represented by the general formula (6a), triethyl phosphite in which $R^6$ is an ethyl group in the general formula (6a) and triisopropyl phosphite in which $R^6$ is an isopropyl group in the general formula (6a) are preferable. Further, as the triaryl phosphite represented by the general formula (6a), triphenyl phosphite in which $R^6$ in the general formula (6a) is a phenyl group, etc. are preferable.

The halogen atoms represented by the reference $X^2$ in the general formula (6b) include, for example, a fluorine atom, chlorine atom, bromine atom, and iodine atom and, among them, the chlorine atom and bromine atom are preferable.

The amine compound, produced as above, of the invention represented by the general formula (1) can be isolated and purified easily from the reaction mixture by ordinary separation means, for example, a solvent extraction method, recrystallization method or column chromatography so that the amine compound having a high purity can be obtained.

The electrophotographic photoreceptor according to the invention (hereinafter simply referred to as a photoreceptor) uses the amine compound of the invention represented by the above-stated general formula (1), and it involves various embodiments. Description is to be made specifically below with reference to the drawings.

FIG. 1 is a fragmentary cross sectional view schematically showing the constitution of an electrophotographic photoreceptor 1 as a first embodiment of the invention. The electrophotographic photoreceptor 1 of this embodiment includes a cylindrical conductive support 11 formed of a conductive material, a charge-generating layer 12 containing a charge-generating substance, and a charge-transporting layer 13 containing a charge-transporting substance. The charge-generating layer 12 is a layer laminated on the outer circumferential surface of the conductive support 11. The charge-transporting layer 13 is a layer laminated further on the charge-generating layer 12. The charge-generating layer 12 and the charge-transporting layer 13 constitute the photosensitive layer 14. That is, the photoreceptor 1 is a laminated type photoreceptor.

The conductive support 11 has a role as an electrode for the photoreceptor 1, as well as functions as a support member for other layers 12 and 13. Further, while the shape of the conductive support 11 is cylindrical in a case of the photoreceptor 1, it is not limited thereto, but may be elliptic, sheet-like or endless belt like shape.

The conductive materials constituting the conductive support 11 can include, for example, metal element such as aluminum, copper, zinc, titanium, etc., and an alloy such as an aluminum alloy and stainless steel, etc. It is not limited to those metal materials, but those prepared by laminating a metal foil, vapor depositing a metal material or vapor depositing or coating a layer of a conductive compound such as conductive polymers, tin oxide, indium oxide, etc., on the surface of polymeric materials such as polyethylene terephthalate, nylon or polystyrene, etc., hard paper, or glass may also be used. Such conductive materials are used while being formed into a predetermined shape.

The surface of the conductive support 11 may optionally be subjected to an anodizing coating film treatment, a surface treatment with a chemical or hot water, etc. a coloring treatment, or a random reflection treatment such as of surface roughening within a range of giving no effects on the picture quality. In an electrophotographic process using a laser as a light source for exposure, since the wavelength of the laser light is uniform, the laser light reflected on the surface of the photoreceptor and the laser light reflected in the inside of the photoreceptor cause interference, and interference fringes caused by the interference sometimes appear on the image to cause image defects. The image defects caused by the interference of the coherent laser light with uniform wavelength can be prevented by applying the treatment described above to the surface of the conductive support 11.

The charge-generating layer 12 contains a charge-generating substance which generates charges by absorbing light as a main component. Examples of effective substances as the charge-generating substance can include azo pigments such as monoazo pigments, bisazo pigments and trisazo pigments; indigo pigments such as indigo and thioindigo; perylene pigments such as perylene imide and polylenic acid anhydride; polycyclic quinone pigments such as anthraquinone and pirenequinone; phthalocyanine pigments such as metal phthalocyanine and non-metal phthalocyanine; squalirium dyes; pyrilium salts and thiopyrilium salts; organic photoconductive materials such as triphenyl methane dyes; and inorganic photoconductive materials such as selenium and amorphous silicon. Those charge-generating substances may be used alone or two or more of them may be used in combination.

In the specification, the phthalocyanine compounds include metal phthalocyanine and non-metal phthalocyanine, as well as derivatives thereof, and also include those in which hydrogen atoms on the benzene ring contained in the phthalocyanine group are substituted with a substituent, for example, a halogen atom such as a chlorine atom or fluorine atom, nitro group, cyano group or sulfonic group. Further, the metal phthalocyanine compound may include those in which ligands are coordinated to the central metal.

Among the charge-generating substances described above, use of the phthalocyanine compound is preferable and use of an oxotitanium phthalocyanine compound represented by the following general formula (A) is further preferable.

(A)

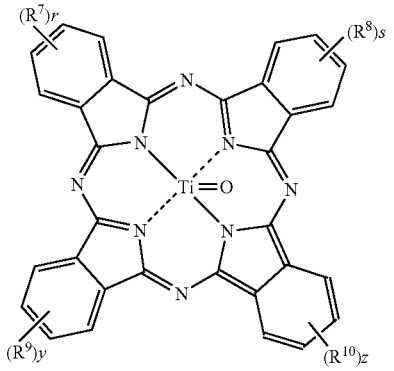

In the general formula (A), $R^7$, $R^8$, $R^9$ and $R^{10}$ each represent a hydrogen atom, a halogen atom, an alkyl group or alkoxy group, and r, s, y and z each represent an integer of from 0 to 4.

In the general formula (A), the halogen atom represented by the references $R^7$, $R^8$, $R^9$ and $R^{10}$ include, for example, a fluorine atom, chlorine atom and bromine atom. The alkyl groups represented by $R^7$, $R^8$, $R^9$ and $R^{10}$ include linear alkyl groups of 1 to 3 carbon atoms such as a methyl group, ethyl group, and n-propyl group; and branched alkyl groups of 1 to 3 carbon atoms such as an isopropyl group. Further, the alkoxy groups represented by $R^7$, $R^8$, $R^9$ and $R^{10}$ include, for example, a linear alkoxy group of 1 to 5 carbon atoms such as a methoxy group, ethoxy group or n-propoxy group; and branched alkoxy groups of 1 to 5 carbon atoms such as an isopropoxy group.

The phthalocyanine compounds, particularly the oxotitanium phthalocyanine compounds represented by the general formula (A) have high charge-generating efficiency and charge injection efficiency. Therefore, the oxotitanium phthalocyanine compounds generate a great amount of charges on absorption of light and inject the generated charges efficiently to the charge-transporting substance contained in the charge-transporting layer 13 without storing them in its inside. Further as described above, since the amine compounds represented by the general formula (1) of high charge-transporting ability are used for the charge-transporting substance contained in the charge-transporting layer 13, the charges generated from the oxotitanium phthalocyanine compounds represented by the general formula (A) by light absorption are efficiently injected to the amine compounds represented by the general formula (1) and transported smoothly to the surface of the photosensitive layer 14. Accordingly, an electrophotographic photoreceptor 1 of high sensitivity and high resolution can be obtained by using the phthalocyanine compound, preferably the oxotitanium phthalocyanine compounds represented by the general formula (A) as the charge-generating substance and the amine compounds of the invention represented by the general formula (1) as the charge-transporting substance as described above.

The phthalocyanine compounds preferably have a specified crystal structure. Among the non-metal phthalocyanine compounds, preferable are X-type, α-type, β-type, γ-type, τ-type, π-type, τ'-type, η-type, η'-type non-metal phthalocyanine compounds and, among them, the X-type non-metal phthalocyanine is used preferably. Further, among the oxotitanium phthalocyanine compounds represented by the general formula (A), oxotitanium phthalocyanine compounds having a crystal structure that at least shows a diffraction peak at a Bragg angle 2θ (error:2θ±0.2°) of 27.2° in the X-ray diffraction spectrum to Cu—Kα characteristic X-rays (wavelength: 1.54 Å) are preferable. In the present specification, the Bragg angle 2θ represents an angle formed between an incident X-ray and a diffracted X-ray, that is, a so-called diffraction angle.

The phthalocyanine compounds such as the oxotitanium phthalocyanine compound represented by the general formula (A) can be produced by a production process known so far, such as a process described in "Phthalocyanine Compounds" written by Moser and Thomas. For example, among oxotitanium phthalocyanine compounds represented by the general formula (A), an oxotitanium phthalocyanine in which $R^7$, $R^8$, $R^9$ and $R^{10}$ each represent a hydrogen atom can be obtained by heat-melting phthalonitrile and titanium tetrachloride, or by reacting them under heating in an appropriate solvent such as α-chloronaphthalene to synthesize a dichlorotitanium phthalocyanine, and then hydrolyzing the same with a base or water. Further, the oxotitanium phthalocyanine can also be produced by reacting isoindoline and titanium tetraalkoxide such as tetrabuthoxy titanium in an appropriate solvent such as an N-methylpyrrolidone.

The charge-generating substance may also be used in combination with sensitizing dyes, for example, triphenylmethane series dyes typically represented by methyl violet, crystal violet, night blue and Victoria blue; acrydine dyes represented by erythrocine, Rhodamine B, Rhodamine 3R, acrydine orange and flapeocine, etc; thiazine dyes typically represented by methylene blue and methylene green; oxazine dyes typically represented by capriblue, meldolablue; cyanine dye; styryl dye; pyrylium salt dye; or thiopyrylium salt dye.

As the method of forming the charge-generating layer 12, a method of vacuum depositing the charge-generating substance described above on the surface of the conductor support 11, or a method of coating the coating solution for use in charge-generating layer obtained by dispersing the charge-generating substance described above into an appropriate solvent on the surface of the conductive support 11, etc. Among them, a method of dispersing a charge-generating substance by a known method into a binder resin solution obtained by mixing a binder resin as a binder into a solvent to prepare a coating solution for use in charge-generating layer and coating the obtained coating solution on the surface of the conductive support 11. The method is to be described below.

The binder resin used for the charge-generating layer 12 can include for example, those resins such as polyester resin, polystyrene resin, polyurethane resin, phenol resin, alkyd resin, melamine resin, epoxy resin, silicone resin, acryl resin, methacryl resin, polycarbonate resin, polyarylate resin, phenoxy resin, polyvinyl butyral resin and polyvinyl formal resin, as well as copolymer resin containing two or more of the repetitive units constituting the resins described above. Specific examples of the copolymer resin can include, for example, those insulative resins such as vinyl chloride-vinyl acetate copolymer resin, vinyl chloride-vinyl acetate-maleic acid anhydride copolymer resin and acrylonitrile-styrene copolymer resin. The binder resin is not restricted to them, but those resins used generally in this field can be used as the binder resin. The resins may be used alone or two or more of the resins may be used in admixture.

The solvents used for the coating solution for use in the charge-generating layer include, for example, halogenated hydrocarbons such as dichloromethane and dichloroethane; ketones such as acetone, methyl ethyl ketone, cyclohexanone; esters such as ethyl acetate and butyl acetate; ethers such as tetrahydrofuran and dioxane; alkylethers of ethylene glycol such as 1,2-dimethoxyethane; aromatic hydrocarbons such as benzene, toluene and xylene; and aprotic polar solvents such as N,N-dimethylformamide and N,N-dimethyl acetoamide. The solvents may be used alone or two or more of them may also be mixed and used as a mixed solvent.

In the charge-generating layer 12 constituted by containing the charge-generating substance and the binder resin, the ratio W1/W2 between the weight W1 of the charge-generating substance and the weight W2 of the binder resin is, preferably, ten hundredth (10/100) or more and ninety-nine hundredth (99/100) or less. In a case where the ratio W1/W2 is less than 10/100, the sensitivity of the photoreceptor 1 is possibly lowered. In a case where the ratio W1/W2 exceeds 99/100, the film strength of the charge-generating layer 12 may possibly be lowered. Further, the dispersibility of the charge-generating substance is decreased to increase coarse particles, the surface charges at the portions other than the portion to be eliminated are decreased by exposure to possibly increase image defects, particularly, image fogging which is referred to as black spots which are fine black spots formed by a toner deposited to the white background.

The charge-generating substance may previously be pulverized by a pulverizer before dispersion into the binder resin solution. The pulverizer used for the pulverization can include, for example, a ball mill, a sand mill, an attritor, a vibration mill and a supersonic dispersing machine.

The dispersing machine used for dispersing the charge-generating substance into the binder resin solution can include, for example, a paint shaker, a ball mill and a sand mill. As the dispersion conditions in this case, appropriate conditions are selected such that intrusion of impurities due to abrasion of a container to be used and members constituting the dispersing machine does not occur.

The coating method of the coating solution for use in charge-generating layer can include, for example, a spraying method, a bar coating method, a roll coating method, a blade method, a wringing method and a dip coating method. Among the coating methods described above, the dip coating method, in particular, is a method of dipping a substrate into a coating tank filled with the coating solution and then pulling it up at a constant speed or at a gradually changing speed thereby forming a layer on the surface of a substrate. Since this is relatively simple and excellent in view of the productivity and the cost, it is used suitably. For stabilizing the dispersibility of the coating solution, a coating solution dispersing device typically represented by a supersonic generation device may also be provided to the apparatus used for the dip coating method. The coating method is not restricted to them but an optimal method can be selected appropriately while taking the physical property of the coating solution and the productivity into consideration.

The thickness of the charge-generating layer 12 is, preferably, 0.05 μm or more and 5 μm or less and, more preferably, 0.1 μm or more and 1 μm or less. In a case where the thickness of the charge-generating layer 12 is less than 0.05 μm, the efficiency of light absorption is lowered to possibly lower the sensitivity of the photoreceptor 1. In a case where the thickness of the charge-generating layer 12 exceeds 5 μm, the movement of the charges in the charge-generating layer 12 constitutes a rate determining step in the process of eliminating the charges on the surface of the photosensitive layer 14 to possibly lower the sensitivity of the photoreceptor 1.

A charge-transporting layer 13 is provided on the charge-generating layer 12. The charge-transporting layer 13 can be constituted including the charge-transporting substance having an ability of accepting charges generated from the charge-generating substance contained in the charge-generating layer 12 and transporting them and a binder resin for binding the charge-transporting substance. For the charge-transporting substance, the amine compound of the invention represented by the general formula (1) is used as described above.

Since the amine compound of the invention represented by the general formula (1) is excellent in the charge transportability, particularly, the hole transportability as described above, by incorporating the amine compound of the invention represented by general formula (1) as the charge-transporting substance in the charge-transporting layer 13, a photoreceptor 1 of high reliability excellent in electrical characteristics such as the chargeability, sensitivity and light responsiveness, electrical durability and circumstantial stability can be attained. Accordingly, the photoreceptor 1, in a case of being used under low temperature circumstance or in a case of being used for high speed electrophotographic process, can provide images at high quality stably for a long period of time under various circumstances without causing degradation of picture quality to the formed images.

As the amine compound of the invention represented by the general formula (1), for example, members selected from the group consisting of the exemplified compounds shown in Table 1 to Table 7 described above may be used alone, or two or more of them may be used in admixture.

For the binder resin constituting the charge-transporting layer 13, those excellent in compatibility with the amine compound of the invention represented by the general formula (1) used as the charge-transporting substance are selected. Specific examples include, for example, polymethyl methacrylate resin, polystyrene resin; vinyl polymer resins such as polyvinyl chloride resin; and copolymer resins containing two or more of repetitive units constituting them, as well as polycarbonate resin, polyester resin, polyester carbonate resin, polysulfone resin, phenoxy resin, epoxy resin, silicone resin, polyarylate resin, polyamide resin, polyether resin, polyurethane resin, polyacrylamide resin and phenol resin. Further, thermosetting resins formed by partially cross-linking the resins described above may also be included. The resins may be used alone or two or more of the resins may be used in admixture. Among the resins described above, polystyrene resin, polycarbonate resin, polyarylate resin, or polyphenylene oxide can be used suitably since it has a volume resistivity of $10^{13}$ Ω·cm or more, and excellent electrical insulative property and is also excellent in the film-forming property and the potential characteristic.

In the charge-transporting layer 13, the ratio A/B between the weight A of the amine compound represented by the general formula (1) contained as the charge-transporting substance and the weight B of the binder resin is, preferably, ten thirtieth (10/30) or more and ten twelfth (10/12) or less. By defining the ratio A/B to 10/30 or more and 10/12 or less and incorporating the binder resin at a high ratio in the charge-transporting layer 13, the printing resistance of the charge-transporting layer 13 can be improved.

As described above, when the ratio A/B is defined as 10/12 or less to increase the ratio of the binder resin, the ratio of the amine compound represented by the general formula (1) contained as the charge-transporting substance is lowered as a result. In a case of using a known charge-transporting substance, when the ratio between the weight of the charge-transporting substance and the weight of the binder resin in the charge-transporting layer 13 (a charge-transporting substance/binder resin) is reduced to 10/12 or less in the same manner, the light responsiveness becomes insufficient to sometimes cause image defects. However, since the amine compound represented by the general formula (1) is excellent in the charge transportability, even when the ratio of the binder resin in the charge-transporting layer 13 is increased by defining the ratio A/B as 10/12 or less, the photoreceptor 1 shows a sufficiently high light responsiveness and images at high quality can be provided. Accordingly, the printing resistance of the charge-transporting layer 13 can be improved to improve the mechanical durability of the photoreceptor 1 without lowering the light responsiveness by setting the ratio A/B to 10/30 or more and 10/12 or less.

In a case where the ratio A/B is less than 10/30 and the ratio of the binder resin is excessively high, sensitivity of the photoreceptor 1 may possibly be lowered. Further, in a case of forming the charge-transporting layer 13 by the dip coating method, when the ratio A/B is less tan 10/30, the viscosity of the coating solution increases to lower the coating speed and possibly worsen the productivity remarkably. Further, in a case of increasing the amount of the solvent in the coating solution in order to suppress the increase of the viscosity of the coating solution, a brushing phenomenon occurs to possibly cause clouding to the formed charge-transporting layer 13. On the other hand, in a case where the ratio A/B exceeds 10/12 and the ratio of the binder resin is excessively low, the printing resistance of the photosensitive layer 14 is deteriorated to increase the amount of film reduction to possibly lower the chargeability of the photoreceptor 1.

The charge-transporting layer 13 may also incorporate other charge-transporting substance than the amine compound represented by the general formula (1) within a range not deteriorating preferable characteristics provided by the amine compound of the invention represented by general formula (1). Other charge-transporting substance used in admixture with the amine compound represented by the general formula (1) can include, for example, benzofuran derivatives other than the amine compound represented by the general formula (1); enamine compounds such as enamine-styryl derivative, enamine-hydrazone derivative, enamine-butadiene derivative and enamine-hexatriene derivative; carbazole derivative; oxazole derivative; oxadiazole derivative; thiazole derivative; thiadiazole derivative; triazole derivative; imidazole derivative; imidazolone derivative; imidazolidine derivative; bisimidazolidine derivative; styryl compound; hydrazone compound; polynuclear aromatic compound; indole derivative; pyrazoline derivative; oxazolone derivative; benzimidazole derivative; quinazoline derivative; acridine derivative; phenazine derivative; aminostilbene derivative; triarylamine derivative; triallylmethane derivative; phenylene diamine derivative; stilbene derivative; and benzidine derivative. Further, they also include those polymers having groups derived from the compounds in the main chain or on the side chains, for example, poly(N-vinyl carbazole), poly(1-vinylpyrene) and poly(9-vinyl anthracene). The charge-transporting substances described above may be used alone or two or more of them may be mixed and used together with the amine compound represented by the general formula (1).

Further, the charge-transporting layer 13 may contain various kinds of additives such as plasticizers, leveling agents or fine particles of organic compound or inorganic compound within a range not deteriorating the preferable characteristics provided by the amine compound of the invention represented by the general formula (1). By the addition of the plasticizer or the leveling agent, the film forming property, flexibility or the surface smoothness of the charge-transporting layer 13 can be improved. By the addition of the fine particles of the organic compound or inorganic compound, the mechanical strength can be increased and the electric characteristics can be improved for the charge-transporting layer 13. The plasticizer can include, for example, a dibasic acid ester such as phthalic acid ester, fatty acid ester, phospholic acid ester, chlorinated paraffin and epoxy type plasticizer. The leveling agent can include, for example, silicone type leveling agent.

The charge-transporting layer 13 can be formed, for example, in the same manner as forming the charge-generating layer 12 by coating, by dissolving or dispersing the charge-transporting substance containing the amine compound represented by the general formula (1) and the binder resin and, optionally, the additives described above into an appropriate solvent to prepare a coating solution for charge-transporting layer, and coating the obtained coating solution on the charge-generating layer 12.

The solvent to be used for the coating solution for use in charge-transporting layer can include, for example, aromatic hydrocarbons such as benzene, toluene, xylene, and monochlorobenzene; halogenated hydrocarbons such as dichloromethane and dichloroethane; ethers such as tetrahydrofuran, dioxane and dimethoxymethyl ether; and aprotic polar solvents such as N,N-dimethyl formamide. The solvents may be used alone or two or more of them may be used in admixture. Further, solvents such as alcohols, acetonitrile or methyl ethyl ketone may be further added and used to the solvent described above.

The coating method for the coating solution for use in charge-transporting layer can include, for example, a spraying method, bar coating method, roll coating method, blade method, wringing method, and dip coating method. Among the coating methods described above, since dip coating method is excellent, particularly, in various points of view as described above, it is used suitably also in a case of forming the charge-transporting layer 13.

The thickness of the charge-transporting layer 13 is, preferably, 5 μm or more and 50 μm or less, and more preferably, 10 μm or more and 40 μm or less. In a case where the thickness of the charge-transporting layer 13 is less than 5 μm, the charge retainability on the surface of the photoreceptor may possibly be lowered. In a case where the thickness of the charge-transporting layer 13 exceeds 50 μm, the resolution power of the photoreceptor 1 may possibly be lowered.

The photosensitive layer 14 has a laminated structure in which the charge-generating layer 12 and the charge-transporting layer 13 formed as described above are laminated. By sharing the charge-generating function and the charge-transporting function to respective layers, materials constituting the respective layers can be selected independently so that materials optimal to the charge-generating function and the charge-transporting function can be selected respectively. Accordingly, the photoreceptor 1 is excellent, particularly, in the electric characteristics such as the chargeability, the sensitivity and the light responsiveness, as well as in electrical and mechanical durabilities.

One or more of sensitizers such as an electron accepting material and a dye may be added to each of the layers of the photosensitive layer 14, that is, the charge-generating layer 12 and the charge-transporting layer 13 within such a range as not deteriorating the preferable characteristics to be provided by the amine compound of the invention represented by the general formula (1). By the addition of the sensitizer, the sensitivity of the photoreceptor 1 is improved and, further, rise of the residual potential and fatigue due to repetitive use can be restricted to improve the electrical durability.

As the electron accepting material, there can be used electron attracting materials, for example: acid anhydrides such as succinic acid anhydride, maleic acid anhydride, phthalic acid anhydride and 4-chloronaphthalic acid anhydride; cyano compounds such as tetracyanoethylene and terephthal malone dinitrile; aldehydes such as 4-nitrobenzaldehyde; anthraquinones such as anthraquinone and 1-nitroanthraquinone; polycyclic or heterocyclic nitro compounds such as 2,4,7-trinitrofluolenone and 2,4,5,7-tetranitrofluorenone or a diphenoquinone compound. Further, the electron attracting materials described above formed into polymeric materials can also be used.

As the dye, for example, xantene series dyes, thiadine dyes, triphenylmethane dyes, quinoline series pigments or organic photoconductive compounds such as copper phthalocyanine can be used. Such organic photoconductive compounds function as an optical sensitizer.

Further, an antioxidant or UV-absorbent, etc. may also be added to each of the layers 12 and 13 of the photosensitive layer 14. Particularly, it is preferable to add the anti-oxidant, UV-absorbent, etc. to the charge-transporting layer 13. By the addition of the anti-oxidant or the UV-absorbent to each of the layers 12, 13 of the photosensitive layer 14, preferably, to the charge-transporting layer 13, the potential characteristics of the photoreceptor 1 can be improved. Further, this can improve the stability of the coating solution in forming each of the layers by coating. Further, this makes it possible to mitigate the wear deterioration due to repetitive use of the photoreceptor 1 to improve the electrical durability.

As the antioxidant, phenol series compounds, hydroquinone series compounds, tocopherol series compounds or amine series compounds etc. can be used. Among them, hindered phenol derivatives, hindered amine derivatives or a mixture thereof are used suitably. The antioxidant is used within a range, preferably, of 0.1 parts by weight or more and 50 parts by weight or less based on 100 parts by weight of the charge-transporting substance. In a case where the amount of the anti-oxidant relative to be used based on 100 parts by weight of the charge-transporting substance is less than 0.1 parts by weight, the effect of improving the stability of the coating solution and the electric durability of the photoreceptor can not possibly be provided sufficiently. On the other hand, in a case where it exceeds 50 parts by weight, undesired effects may possibly be given on the characteristics of the photoreceptor.

Figure 2:
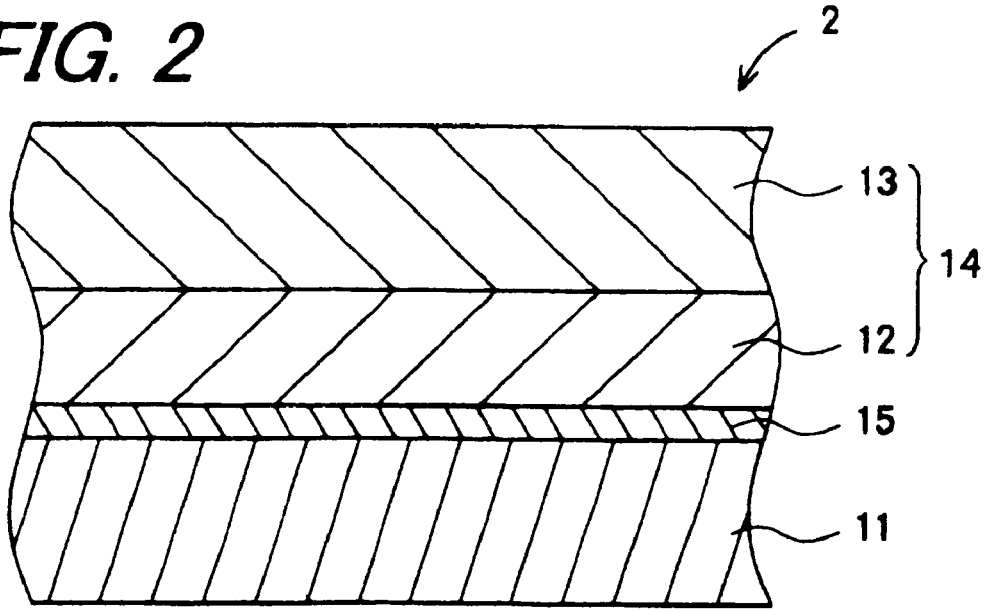
FIG. 2 is a fragmentary cross sectional view schematically showing the constitution of an electrophotographic photoreceptor as a second embodiment of electrophotographic photoreceptor according to the invention.

FIG. 2 is a fragmentary cross sectional view schematically showing the constitution of an electrophotographic photoreceptor 2 as a second embodiment of an electrophotographic photoreceptor according to the invention. The electrophotographic photoreceptor 2 of this embodiment is similar to the electrophotographic photoreceptor 1 of the first embodiment shown in FIG. 1 in which corresponding portions carry identical reference numerals for which descriptions are to be omitted.

What is to be noted in the electrophotographic photoreceptor 2 is that an intermediate layer 15 is disposed between a conductive support 11 and a photosensitive layer 14.

In a case where the intermediate layer 15 is not present between the conductive support 11 and the photosensitive layer 14, charges are injected from the conductive support 11 to the photosensitive layer 14 to lower the chargeability of the photosensitive layer 14 and decrease the surface charges in the portions other than those to be exposed to sometimes result in defects such as fogging in images. Particularly, in a case of forming images by using a reversal development process, since a toner is deposited to a portion where the surface charges are decreased by exposure to form toner images, when the surface charges are decreased by other factors than exposure, image fogging referred to as the black spots which are fine black spots formed by the toner deposited on the white background occur to possibly result in remarkable degradation of the picture quality. As described above, in a case where the intermediate layer 15 is not present between the conductive support 11 and the photosensitive layer 14, lowering of the chargeability occurs in the fine region due to the defects of the conductive support 11 or the photosensitive layer 14 to cause image fogging such as black spots to possibly form remarkable image defects.

In the photosensitive body 2 of this embodiment, since the intermediate layer 15 is provided between the conductive support 11 and the photosensitive layer 14 as described above, injection of charges from the conductive support 11 to the photosensitive layer 14 can be prevented. Accordingly, lowering of the chargeability of the photosensitive layer 14 can be prevented, and decrease of the surface charges in the portions other than the exposed portion can be suppressed to prevent occurrence of defects such as fogging in the images.

Further, by the provision of the intermediate layer 15, the defects on the surface of the conductive support 11 can be covered to obtain a uniform surface so that the film-forming property of photosensitive layer 14 can be improved. Further, since the intermediate layer 15 functions as an adhesive for adhering the conductive support 11 and the photosensitive layer 14, peeling of the photosensitive layer 14 from the conductive support 11 can be suppressed.

For the intermediate layer 15, a resin layer comprising various kinds of resin materials or an alumite layer is used.

The resin material constituting the resin layer can include, for example, synthetic resins such as polyethylene resin, polypropylene resin, polystyrene resin, acrylic resin, vinyl chloride resin, vinyl acetate resin, polyurethane resin, epoxy resin, polyester resin, melamine resin, silicone resin, polyvinyl butyral resin and polyamide resin, as well as copolymer resins containing two or more of repetitive units constituting the synthesis resins. Further, it may also include casein, gelatin, polyvinyl alcohol and ethyl cellulose. Among the resins, use of the polyamide resin is preferable and, particularly, alcohol soluble nylon resin is used preferably. The preferable alcohol soluble nylon resin can include so-called a copolymerized nylon formed by co polymerizing, for example, 6-nylon, 6,6-nylon, 6,10-nylon, 11-nylon, 12-nylon, as well as resins formed by chemically modifying nylon such as N-alkoxy methyl modified nylon and N-alkoxy ethyl modified nylon.

The intermediate layer 15 may contain particles such as metal oxide particles. By incorporation of the particles in the intermediate layer 15, the volumic resistance value of the intermediate layer 15 can be controlled to enhance the effect of preventing injection of the charges from the conductive support 11 to the photosensitive layer 14, and electric characteristics of the photoreceptor 2 can be maintained under various circumstances to improve the circumstantial stability.

The metal oxide particles can include, for example, particles of titanium oxide, aluminum oxide, aluminum hydroxide and tin oxide.

The intermediate layer 15 can be formed, for example, by preparing a coating solution for intermediate layer by dissolving or dispersing the resin described above into an appropriate solvent and coating the coating solution on the surface of the conductive support 11. In a case where the particles such as metal oxide particles described above are incorporated in the intermediate layer 15, the intermediate layer 15 can be formed by dispersing the particles in a resin solution obtained by dissolving the resin into an appropriate solvent to prepare a coating solution for intermediate layer and coating the coating solution on the surface of the conductive support 11.

As the solvent of the coating solution for intermediate layer, water, various organic solvents or a mixed solvent thereof is used. Among them, a single solvent such as water, methanol, ethanol or butanol; or a mixed solvent such as of water and alcohol, two or more kinds of alcohols, acetone or dioxolane and alcohols, chloro solvent such as dichloroethane, chloroform or trichloroethane and alcohols is used preferably.

As the method of dispersing the particles in the resin solution, a known dispersion method using, for example, a ball mill, sand mill, attritor, vibration mill, supersonic dispersing machine or paint shaker can be used.

In the coating solution for intermediate layer, the ratio C/D between the total weight C of the resin and the metal oxide and the weight D of the solvent used to the coating solution for intermediate layer, is preferably, from 1/99 to 40/60 and, more preferably, from 2/98 to 30/70. Further, the ratio E/F between the weight E of the resin and the weight F of the metal oxide is, preferably, form 90/10 to 1/99 and, more preferably, from 70/30 to 5/95.

The coating method for the coating solution for intermediate layer can include, for example, a spraying method, bar coating method, roll coating method, blade method, wringing method and dip coating method. Among them, since the dipcoating method is relatively simple and excellent in view of the productivity and the cost as described above, it is used suitably also in a case of forming the intermediate layer 15.

The thickness of the intermediate layer 15 is, preferably, 0.01 μm or more and 20 μm or less and, more preferably, 0.05 μm or more 10 μm or less. In a case where the thickness of the intermediate layer 15 is less than 0.01 μm, it no more functions substantially as the intermediate layer 15, and uniform surface property by covering the defects of the conductive support 11 can not be obtained to result in a worry of not capable of preventing injection of charges from the conductive support 11 to the photosensitive layer 14 to possibly lower the chargeability of the photosensitive layer 14. Increase of the thickness of the intermediate layer 15 to more than 20 μm is not preferable since the formation of the intermediate layer 15 is difficult in a case of forming the intermediate layer 15 by the dip coating method and the photosensitive layer 14 can not be formed uniformly over the intermediate layer 15 to possibly lower the sensitivity of the photoreceptor 2.

Also in this embodiment, various kinds of additives such as a plasticizer, leveling agent or fine particles of organic compound or inorganic compound may also be added to the charge-transporting layer 13 like in the first embodiment. Further, a sensitizers such as an electron accepting substance or dye, an anti-oxidant or additive such as a UV-absorbent may also be added to each of the layers 12 and 13 of the photosensitive layer 14.

Figure 3:
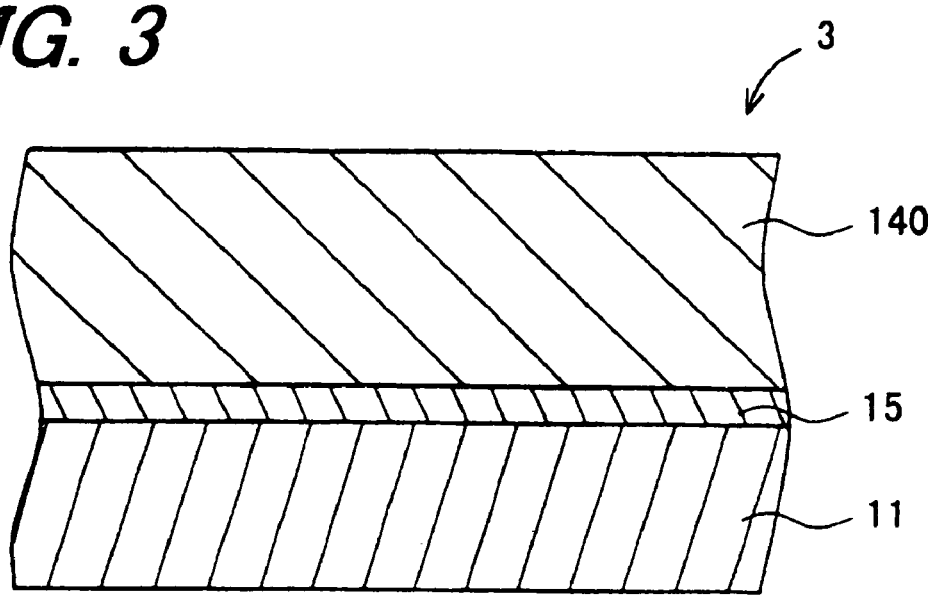
FIG. 3 is a fragmentary cross sectional view schematically showing the constitution of an electrophotographic photoreceptor as a third embodiment of electrophotographic photoreceptor according to the invention.

FIG. 3 is a fragmentary cross sectional view schematically showing the constitution of an electrophotographic photoreceptor 3 as a third embodiment of the electrophotographic photoreceptor according to the invention. The electrophotographic photoreceptor 3 of this embodiment is similar to the electrophotographic photoreceptor 2 of the second embodiment shown in FIG. 2 in which corresponding portions carry identical reference numerals for which descriptions are to be omitted.

What is to be noted in the electrophotographic photoreceptor 3 is that the photosensitive layer 140 has a single-layered structure comprising a single layer containing both the charge-generating substance and the charge-transporting substance. That is, the photoreceptor 3 is a single-layered type photoreceptor.

The single-layered photoreceptor 3 of this embodiment is suitable as a photoreceptor for use in a positively charged image forming apparatus with less generation of ozone and, since the photosensitive layer 140 to be coated consists of only one layer, the production cost and the yield are excellent compared with the laminated type photoreceptors 1 and 2 of the first embodiment and the second embodiment.

The photosensitive layer 140 can be formed by bonding the charge-transporting substance containing the amine compound of the invention represented by the general formula (1) and the charge-generating substance described above by a binder resin. As the binder resin, those exemplified as the binder resin for the charge-transporting layer 13 according to the first embodiment can be used. Like in the photosensitive layer 14 according to the first embodiment, various kinds of additives such as a plasticizer, leveling agent, fine particles of organic compound or inorganic compound, sensitizes such as an electron accepting substance or a dye, an antioxidant or a UV-ray absorbent may also be added to the photosensitive layer 140.

The photosensitive layer 140 can be formed by the same method as for the charge-transporting layer 13 provided in the photoreceptor 1 of the first embodiment. For example, the photosensitive layer 140 can be formed by dissolving or dispersing the charge-generating substance, the charge-transporting substance containing the amine compound according to the invention represented by the general formula (1), the binder resin and, optionally, the additives described above into an appropriate solvent, which is identical with that of the coating solution for the charge-transporting layer, to prepare a coating solution for photosensitive layer, and coating the coating solution for photosensitive layer onto the intermediate layer 15 by a dip coating method or the like.

The ratio A'/B' between the weight A'of the amine compound represented by the general formula (1) and the weight B' of the binder resin in the photosensitive layer 140 is, preferably, 10/30 or more and 10/12 or less by the same reason as that of the ratio A/B between the weight A for the amine compound represented by the general formula (1) and the weight B for the binder resin in the charge-transporting layer 13 according to the first embodiment.

The thickness of the photosensitive layer 140 is, preferably, 5 μm or more and 100 μm or less and, more preferably, 10 μm or more and 50 μm or less. In a case where the thickness of the photosensitive layer 140 is less than 5 μm, the charge retainability on the surface of the photoreceptor may possibly be lowered. In a case where the thickness of the photosensitive layer 140 exceeds 100 μm, the productivity may possibly be lowered.

The electrophotographic photoreceptor according to the invention is not restricted to the constitution for the electrophotographic photoreceptors 1, 2, 3 of the first embodiment to the third embodiment shown in FIG. 1 to FIG. 3 described previously but it may be of other different constitutions so long as the amine compound according to the invention represented by the general formula (1) is contained in the photosensitive layer.

For example, it may be of such a constitution that a surface protective layer is provided on the surface of the photosensitive layer 14 or 140. Mechanical durability of the photoreceptor 1, 2 or 3 can be improved by providing surface protective layer on the surface of the photosensitive layer 14 or 140. Further, it can prevent undesired chemical effects of an active gas such as ozone or nitrogen oxide (NOx) generated by corona discharge in charging the surface of the photoreceptor on the photosensitive layer 14 or 140. As a result, electrical durability of the photoreceptor 1, 2 or 3 can be improved.

As the surface protective layer, a layer comprising, for example, a resin, an inorganic filler-containing resin or inorganic oxide is used.

Then, the image forming apparatus having the electrophotographic photoreceptor according to the invention is to be described. The image forming apparatus according to the invention is not restricted to the following contents of the description.

Figure 4:
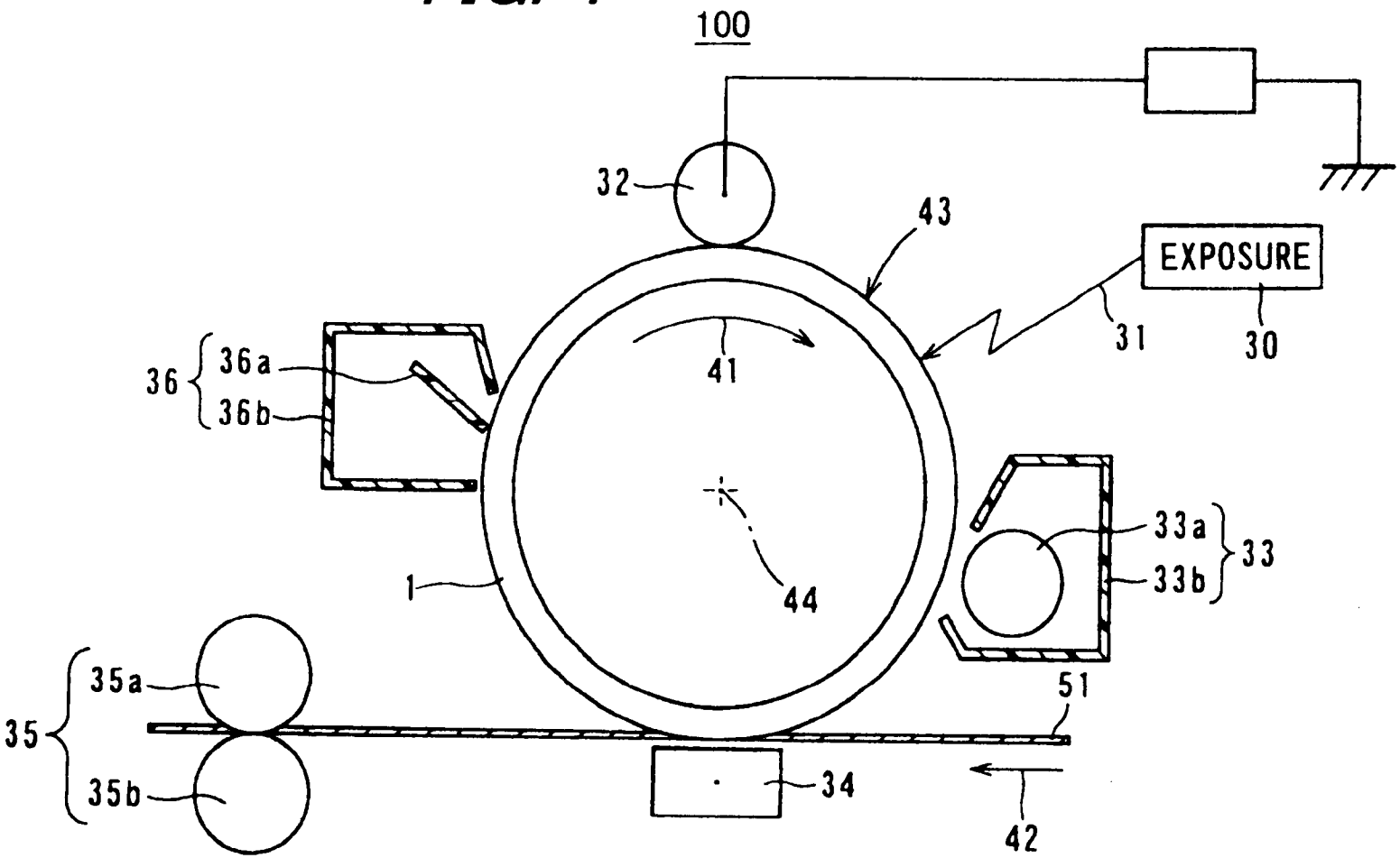
FIG. 4 is a side elevational view for the arrangement schematically showing the constitution of an image forming apparatus as an embodiment of image forming apparatus according to the invention.

FIG. 4 is a side elevational view for the arrangement schematically showing the constitution of an image forming apparatus 100 as an embodiment of the image forming apparatus according to the invention. The image forming apparatus 100 shown in FIG. 4 has, mounted thereon, a photoreceptor 1 shown in FIG. 1 as described above as a first embodiment of the electrophotographic photoreceptor according to the invention. The constitution of the image forming apparatus 100 and the image forming operation thereof are to be described with reference to FIG. 4.

The image forming apparatus 100 has the photoreceptor 1 supported rotationally on an apparatus main body not illustrated and a driving means not illustrated for rotationally driving the photoreceptor 1 in the direction of an arrow 41 around a rotational axis 44. The driving means comprises, for example, a motor as a driving source and rotationally drives the photoreceptor 1 at a predetermined circumferential speed Vp (herein after the circumferential speed Vp is also referred to as the rotational circumferential speed Vp of the photoreceptor 1) by transmitting the power from the motor by way of gears not illustrated to a support that constitutes the core of the photoreceptor 1.

At the periphery of the photoreceptor 1, are provided a charger 32, an exposure means 30, a developing device 33, a transfer device 34 and a cleaner 36 in this order from the upstream to the downstream in the rotational direction of the photoreceptor 1 shown by an arrow 41. The cleaner 36 is provided together with a not illustrated charge elimination lamp.

The charger 32 is a charging means for charging the surface 43 of the photoreceptor 1 to a predetermined potential. The charger 32 is, for example, a contact type charging means such as a charging roller.

The exposure means 30 has, for example, a semiconductor laser as a light source, exposes the surface 43 of the charged photoreceptor 1 by a light 31 of a laser beam or the like outputted in accordance with the image information from the light source to thereby form static latent images on the surface 43 of the photoreceptor 1.

The developing device 33 is a developing means of developing static latent images formed on the surface 43 of the photoreceptor 1 with the developer thereby forming toner image as visible images and it comprises a developing roller 33*a* opposed to the photoreceptor 1 and supplying a toner to the surface 43 of the photoreceptor 1 and a casing 33*b* for rotationally supporting the developing roller 33*a* around the rotational axis parallel with the rotational axis 44 of the photoreceptor 1, and containing a toner-containing developer to the inner space thereof.

The transfer device 34 is a transferring means for transferring the toner images formed on the surface 43 of the photoreceptor 1 from the surface 43 of the photoreceptor 1 to recording paper 51 as a transfer material. The transfer device 34 is a non-contact type transferring means having a charging means, for example, a corona discharger and transferring toner images onto the recording paper 51 by applying charges of a polarity opposite to that of the toner to the recording paper 51.

The cleaner 36 is a cleaning means for cleaning the surface of the photoreceptor 1 after transfer of the toner images and comprises a cleaning blade 36*a* pressed to the surface 43 of the photoreceptor for peeling the toner remaining on the surface 43 of the photoreceptor 1 after transferring operation by the transfer device 34 from the surface 43, and a recovery casing 36*b* for containing the toner peeled by the cleaning blade 36*a*.

Further, the fixing device 35 as a fixing means is provided for fixing the transferred toner images in the direction along which the recording paper 51 is conveyed after passage between the photoreceptor 1 and the transfer device 34. The fixing device 35 comprises a heating roller 35*a* having a not illustrated heating means and a pressing roller 35*b* opposed to the heating roller 35*a* for forming an abutting portion being pressed by the heating roller 35*a*.

The image forming operation by the image forming apparatus 100 is to be described. At first, in accordance with an instruction from a not illustrated control section, the photoreceptor 1 is rotationally driven by the driving means along the direction of an arrow 41 and the surface 43 thereof is charged uniformly to a predetermined positive or negative potential by the charger 32 situated upstream of the focussing point of a light 31 from the exposure means 30 in the rotational direction to the photoreceptor 1.

Then, in accordance with the instruction from the control section, the light 31 is irradiated from the exposure means 30 to the charged surface 43 of the photoreceptor 1. The light 31 from the light source is scanned repetitively in the longitudinal direction of the photoreceptor 1 as a main scanning direction based on the image information. By rotationally driving the photoreceptor 1 to scan the light 31 from the light source repetitively based on the image information, exposure corresponding to the image information can be applied to the surface 43 of the photoreceptor 1. By the exposure, the surface charges at a portion irradiated with the light 31 are decreased to cause difference between the surface potential at a portion where the light 31 has been irradiated and the surface potential at a portion where the light 31 has not been irradiated, to form static latent images on the surface 43 of the photoreceptor 1. Further, in synchronization with the exposure to the photoreceptor 1, the recording paper 51 is supplied by the conveying means from the direction of the arrow 42 to the transfer position between the transfer device 34 and the photoreceptor 1.

Then, a toner is supplied from the developing roller 33*a* of the developing device 33 situated to the downstream of the focusing point of the light 31 from the light source in the rotational direction of the photoreceptor 1 to the surface 43 of the photoreceptor 1 formed with the static latent images. This develops the static latent images to form toner images as visible images to the surface 43 of the photoreceptor 1. When the recording paper 51 is supplied between the photoreceptor 1 and the transfer device 34, charges at a polarity opposite to that of the toner are given by the transfer device 34 to the recording paper 51 thereby transferring the toner images formed on the surface 43 of the photoreceptor 1 to the recording paper 51.

The recording paper 51 transferred with the toner images is conveyed by the conveying means to the fixing device 35 and heated and pressed in passing the abutted portion between the heating roller 35*a* and the pressing roller 35*b* of the fixing device 35. This fixes the toner images on the recording paper 51 to form firm images. The recording paper 51 thus formed with the images is discharged by a conveying means to the outside of the image forming apparatus 100.

On the other hand, after transfer of the toner images to the recording paper 51, the photoreceptor 1 that rotates further in the direction of the arrow 41 is rubbed at the surface 43 by the cleaning blade 36*a* provided to the cleaner 36 and cleaned. The surface 43 of the photoreceptor 1 thus removed with the toner is charge-eliminated by the light from the charge illumination lamp, by which the static latent images on the surface 43 of the photoreceptor 1 are eliminated. Then, the photoreceptor 1 is further driven rotationally, and a series of operation starting from charging are repeated again. As described above, images are formed continuously.

The photoreceptor 1 provided to the image forming apparatus 100 contains the amine compound of the invention represented by the general formula (1) as the charge-transporting substance in the photosensitive layer 14 and is excellent in the electric characteristics such as the chargeability, the sensitivity and the light responsiveness, electrical and mechanical durabilities, as well as circumstantial stability. Accordingly, an image forming apparatus 100 of high reliability capable of forming images at high quality stably for a long period under various circumstances can be attained.

Further, since the photoreceptor 1 does not result in lower the picture quality even in a case where it is used for a high speed electrophotographic process, the image forming speed of the image forming apparatus 100 can be increased. Images at high quality can be provided, for example, also by using a photoreceptor of 30 mm diameter and 340 mm length in the longitudinal direction, and conducting an electrophotographic process at high speed while setting the rotational circumferential speed Vp of the photoreceptor 1 to about 100 to 140 mm on every sec and forming images at a image forming speed of the image forming apparatus 100 to a high speed of about 25 sheets of A4 size paper/min specified according to JIS P 0138.

The image forming apparatus according to the invention is not restricted to the constitution of the image forming apparatus 100 shown in FIG. 4 but it may be of any other different constitution so long as the photoreceptor according to the invention can be used therein.

For example, while the charger 32 is the contact type charging means in the image forming apparatus 100 of this embodiment, this is not restrictive thereto but may be a no-contact type charging means such as a corona discharger. Further, while the transfer device 34 is the no-contact type transferring means for conducting transfer without using a pressing force, this is not restrictive but may be a contact type transferring means of conducting transfer by utilizing the pressing force. As the contact type transferring means, those, for example, having a transfer roller, pressing the transfer roller to the photoreceptor 1 from the side opposite to the abutting surface of the recording paper 51 that is abutted against the surface 43 of the photoreceptor 1, and applying a voltage to the transfer roller in a state where the photoreceptor 1 and the recording paper 51 are in press contact with each other thereby transferring the toner images onto the recording paper 51 can be used.

EXAMPLE

The present invention is to be described further specifically with reference to preparation examples, examples and comparative examples but the invention is not restricted to the following descriptions.

Preparation Example

Preparation Example 1

Preparation of Exemplified Compound No. 1

[Preparation of Amine-aldehyde Intermediate Product]

9.2 g (1.2 molar amount) of phosphorus oxychloride was gradually added under ice cooling into 100 mL of anhydrous N, N-dimethyl formamide (DMF), and stirred for about 30 min, to prepare a Vilsmeier reagent. 15.7 g (1.0 molar amount) of N, N-bis(p-tolyl)-1-benzofuran-5-amine represented by the following structural formula (7) was gradually added in the solution under ice cooling. Then, they were gradually heated to increase the reaction temperature to 80° C. and stirred for 3 hours while heating so as to keep at 80° C. After the completion of the reaction, the reaction solution was allowed to cool, which was gradually added to 800 mL of an aqueous 4N solution of sodium hydroxide under cooling to cause precipitation. The resultant precipitates were separated by filtration, thoroughly washed with water and then recrystallized with a mixed solvent of ethanol and ethyl acetate to obtain 15.4 g of a yellow powdery compound.

(7)

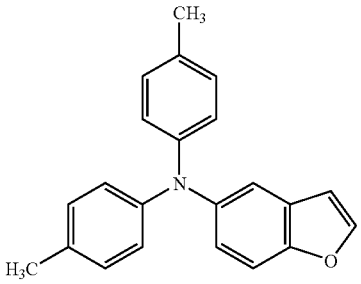

As a result of analyzing the obtained compound by liquid chromatography-mass spectrometry (simply referred to as LC-MS), a peak corresponding to molecular ion $[M+H]^+$ in which a proton was added to the amine-aldehyde intermediate product represented by the following structural formula (8) (calculated value of the molecular weight: 341.41) was observed at 342.5. It was confirmed from the analysis that the obtained compound was an amine-aldehyde intermediate product represented by the following structural formula (8) (yield: 90.0%). Further, based on the result of LC-MS analysis, it was found that the purity of the obtained amine-aldehyde intermediate product was 95.7%.

(8)

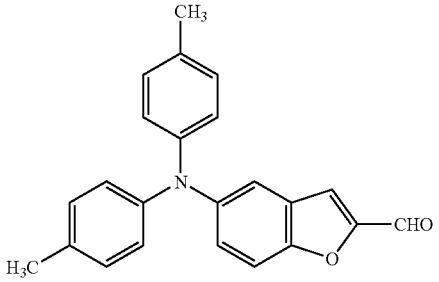

[Preparation of Exemplified Compound No. 1]

7.90 g (1.0 molar amount) of the obtained amine-aldehyde intermediate product represented by the structural formula (8) and 7.06 (1.2 molar amount) of diethyl cinnamyl phosphonate represented by the following structural formula (9) were dissolved into 80 mL of anhydrous DMF and, while keeping the obtained solution at 0° C., 2.92 g (1.1 molar amount) of potassium t-butoxide was gradually added to the solution. After stirring the reaction solution at a room temperature for one hour, the reaction solution was heated to 40° C. and, while heating the reaction solution such that the temperature was kept at 40° C., they were reacted by stirring for 5 hours. After allowing the reaction solution to cool, it was poured into excess methanol. Precipitates were recovered and dissolved in toluene to form a toluene solution. The toluene solution was transferred to a separatory funnel and, after washing with water, an organic layer was taken out and the taken out organic layer was dried with magnesium sulfate. After drying, the organic layer removed with solid matters was concentrated and subjected to silica gel column chromatography to obtain 9.5 g of yellow crystals.

(9)

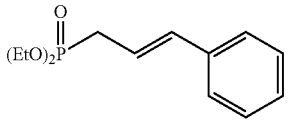

(where Et represents an ethyl group).

As a result of LC-MS analysis of the obtained yellow crystals, a peak corresponding to the molecular ion $[M+H]^+$ in which a proton was added to the aimed amine compound of the Exemplified Compound No. 1 shown in Table 1 (calculated value of molecular weight: 441.21) was observed at 442.5. From the result, it was confirmed that the obtained yellow crystals were the amine compound of Exemplified Compound No. 1 (yield: 93%). Further, it was found based on the result of LC-MS analysis that the purity of the obtained Exemplified Compound No. 1 was 99.4%.

As described above, the amine compound of Exemplified Compound No. 1 shown in Table 1 could be obtained at a high yield by formylating the benzofuran amine compound represented by the structural formula (7) and reacting a Wittig reagent represented by the structural formula (9) to the obtained amine-aldehyde intermediate product represented by the structural formula (8) under basic conditions.

Preparation Example 2

Preparation of Exemplified Compound No. 25

1.80 g (1.0 molar amount) of the amine-aldehyde intermediate product representedby the structural formula (8) prepared in the same manner as in Preparation Example 1 and 1.41 g (1.2 molar amount) of a Wittig reagent represented by the following structural formula (10) were dissolved into 80 mL of anhydrous DMF and, while keeping the obtained solution at 0° C., 0.82 g (1.4 molar amount) of potassium t-butoxide was gradually added to the solution. After stirring the reaction solution at a room temperature for one hour, the reaction solution was heated to 40° C. and, while heating the reaction solution such that the temperature was kept at 40° C., they were reacted by stirring for 5 hours. After allowing the reaction solution to cool, it was poured into excess methanol. Precipitates were recovered and dissolved in toluene to form a toluene solution. The toluene solution was transferred to a separatory funnel and, after washing with water, an organic layer was taken out and the taken out organic layer was dried with magnesium sulfate. After drying, the organic layer removed with solid matters was concentrated and subjected to silica gel column chromatography to obtain 2.22 g of yellow crystals.

(10)

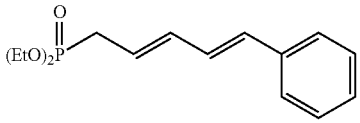

(where Et represents an ethyl group).

As a result of LC-MS analysis of the obtained yellow crystals, a peak corresponding to the molecular ion $[M+H]^+$ in which a proton was added to the aimed amine compound of Exemplified Compound No. 25 shown in Table 2 (calculated value of molecular weight: 467.22) was observed at 468.7. From the result, it was confirmed that the obtained yellow crystals were the amine compound of Exemplified Compound No. 25 (yield: 90%). Further, it was found based on the result of LC-MS analysis that the purity of the obtained Exemplified Compound No. 25 was 99.1%.

As described above, the amine compound of Exemplified Compound No. 25 shown in Table 2 could be obtained at a high yield by reacting the Wittig reagent represented by the structural formula (10) to the amine-aldehyde intermediate product represented by the structural formula (8) under basic conditions.

Example

Example 1

After adding 1 part by weight of an azo compound represented by the following structural formula (11) as a charge-generating substance to a resin solution obtained by dissolving 1 part by weight of a phenoxy resin (PKHH: manufactured by Union Carbide Co.) to 99 parts by weight of tetrahydrofuran (THF), they were dispersed for 2 hours by a paint shaker to prepare a coating solution for use in charge-generating layer. After coating the coating solution for use in charge-generating layer on aluminum for a conductive support prepared by vapor depositing aluminum on the surface of a polyester film of 80 μm thickness by a Baker applicator, it was dried to form a charge-generating layer of 0.3 μm thickness.

(11)

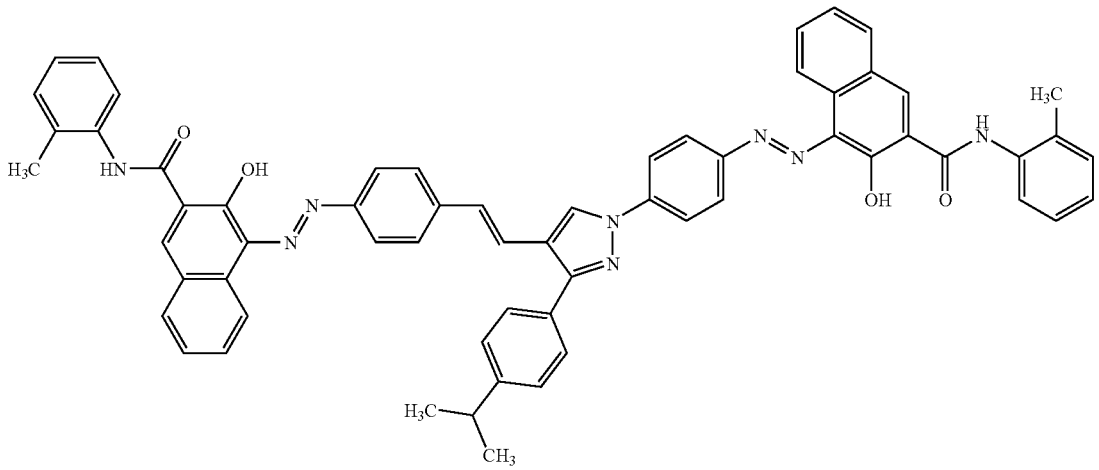

Then, 8 parts by weight of the amine compound of Exemplified Compound No. 0.1 shown in Table 1 as a charge-transporting substance and 10 parts by weight of a polycarbonate resin (C-1400: manufactured by Teijin Kasei Co.) were dissolved in 80 parts by weight of THF to prepare a coating solution for use in charge-transporting layer. After coating the coating solution for use in charge-transporting layer to the charge-generating layer formed previously by a Baker applicator, it was dried to form a charge-transporting layer of 10 μm thickness.

As described above, an electrophotographic photoreceptor of Example 1 having a laminated type layer structure shown in FIG. 1 was manufactured.

Examples 2 to 5

Electrophotographic light sensitive bodies of Examples 2 to 5 were manufactured in the same manner as in Example 1 except for using the amine compound of Exemplified Compound No. 14, 23, 41 or 61 shown in Table 1 to Table 7 instead of the amine compound of Exemplified Compound No. 1 as the charge-transporting substance.

Comparative Example 1

Electrophotographic light sensitive bodies of Comparative Example 1 were manufactured in the same manner as in Example 1 except for using Comparative Compound A represented by the following structural formula (12) instead of the amine compound of Exemplified Compound No. 1 as the charge-transporting substance.

(12)

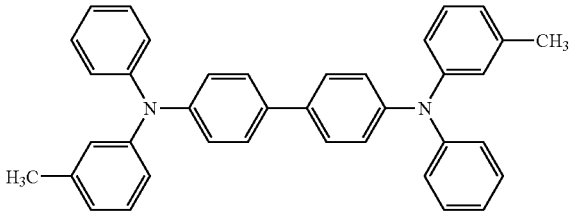

Comparative Example 2

An electrophotographic photoreceptor of Comparative Example 2 was manufactured in the same manner as in Example 1 except for using a Comparative Compound B represented by the following structural formula (13) instead of the amine compound of Exemplified Compound No. 1 as the charge-transporting substance.

(13)

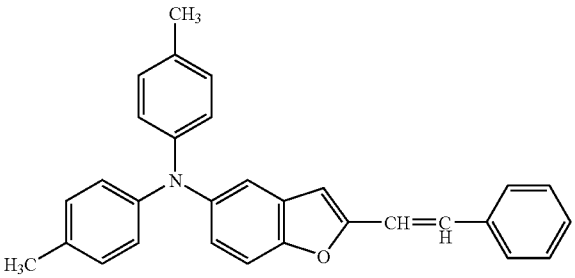

[Evaluation 1]

Each of the photoreceptors of Examples 1 to 5 and Comparative Examples 1 and 2 manufactured as described above was used and the charge movability of the charge-transporting substance used in each of the photoreceptors was measured as described below. Gold was vapor deposited to the surface of the charge-transporting layer of each of the photoreceptors and, while reducing the pressure at a room temperature, an electric field at an electric field strength of $2.5\times10^5$ V/cm was applied to each photoreceptor, the charge movability ($cm^2$/V.sec) was measured by a time-of-flight method, and the value was defined as the charge movability of the charge-transporting substance used for each of the photoreceptors. The result of the measurement is shown in Table 8.

TABLE 8

| | Charge-transporting substance | Charge mobility ($cm^2/V \cdot sec$) |
|---|---|---|
| Example 1 | Exemplified Compound 1 | $2.8 \times 10^{-4}$ |
| Example 2 | Exemplified Compound 14 | $2.4 \times 10^{-4}$ |
| Example 3 | Exemplified Compound 23 | $3.3 \times 10^{-4}$ |
| Example 4 | Exemplified Compound 41 | $1.8 \times 10^{-4}$ |
| Example 5 | Exemplified Compound 61 | $2.1 \times 10^{-4}$ |
| Comparative Example 1 | Comparative Compound A | $1.2 \times 10^{-6}$ |
| Comparative Example 2 | Comparative Compound B | $7.5 \times 10^{-6}$ |

From the comparison between Examples 1 to 5 and Comparative Examples 1 and 2, it was found that the amine compound of the invention represented by the general formula (1) has a charge movability higher by 2 digits or more compared with an amine stilbene compound such as Comparative Example B corresponding to the compound with n=0 in the general formula (1) and a triphenylamine dimer (simply referred to as TPD) such as Comparative Compound A as the charge-transporting substance known so far.

Example 6

9 parts by weight of dendritic titanium oxide surface treated with aluminum oxide (chemical formula: $Al_2O_3$) and zirconium dioxide (chemical formula: $ZrO_2$) (TTO-D-1: manufactured by Ishihara Industry Co.) and 9 parts by weight of a copolymerized nylon resin (CM 8000: manufactured by Toray Co.) were added to a solvent mixture comprising 41 parts by weight of 1,3-dioxolan and 41 parts by weight of methanol, and dispersed for 12 hours by using a paint shaker to prepare a coating solution for use in intermediate layer. After coating the prepared coating solution for use in intermediate layer on a plate-like conductive support formed of aluminum of 0.2 mm thickness by a Baker applicator, it was dried to form an intermediate layer of 1 μm thickness.

Then, after adding 2 parts by weight of an azo compound represented by the following structural formula (14) as the charge-generating substance to a resin solution obtained by dissolving 1 part by weight of a polyvinyl butyral resin (BX-1: manufactured by Sekisui Chemical Industry Co.) to 97 parts by weight of THF, it was dispersed for 10 hours by a paint shaker to prepare a coating solution for use in charge-generating layer. After coating the coating solution for use in charge-generating layer on the previously formed intermediate layer by a Baker applicator, it was dried to form a charge-generating layer of 0.3 μm thickness.

(14)

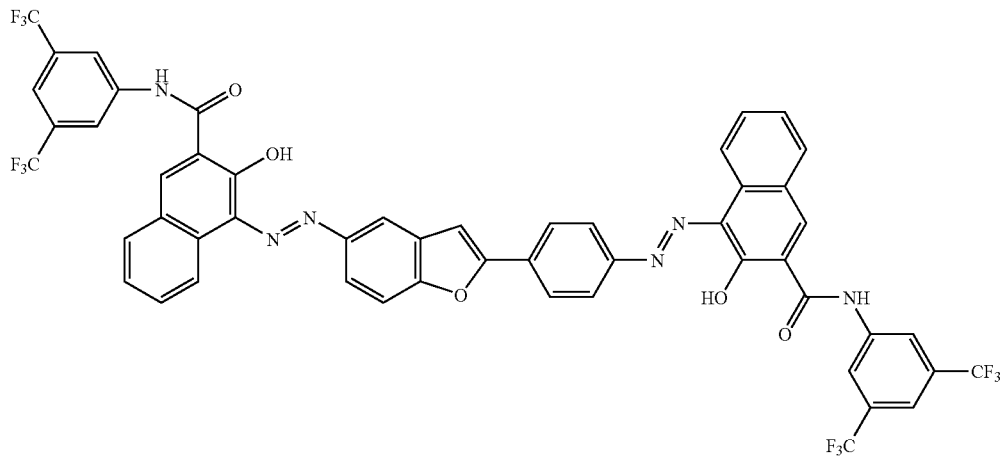

Then, 10 parts by weight of the amine compound of Exemplified Compound No. 1 shown in Table 1 as a charge-transporting substance, 14 parts by weight of a polycarbonate resin as a binder resin (Z200: manufactured by Mitsubishi Gas Chemical Co.), and 0.2 parts by weight of 2,6-di-t-butyl-4-methylphenol were dissolved in 80 parts by weight of THF, to prepare a coating solution for use in charge-transporting layer. After coating the coating solution for use in charge-transporting layer on the previously formed charge-generating layer by an Baker applicator, it was dried to form a charge-transporting layer of 18 μm thickness.

As described above, an electrophotographic photoreceptor of Example 6 having the laminated type layer structure shown in FIG. 2 was manufactured.

Examples 7 to 9

Electrophotographic photoreceptors of Examples 7 to 9 were manufactured in the same manner as in Example 6 except for using the amine compound of Exemplified Compound No. 18, 25 or 38 shown in Table 1 to Table 7 instead of the amine compound of Exemplified Compound No. 1 as a charge-transporting substance.

Comparative Examples 3, 4

Electrophotographic photoreceptors of Comparative Examples 3 and 4 were manufactured in the same manner as in. Example 6 except for using Comparative Compound A represented by the following structural formula (12) or Comparative Compound B represented by the structural formula (13) instead of the amine compound of Exemplified Compound No. 1 as a charge-transporting substance.

Example 10

In the same manner as in Example 6, an intermediate layer of 1 μm thickness was formed on a plate-like conductive support formed of aluminum of 0.2 mm thickness was formed.

Then, 1 part by weight of the azo compound represented by the structural formula (14) as a charge-generating substance, 12 parts by weight of a polycarbonate resin (Z-400: manufactured by Mitsubishi Gas Chemical Co.) as a binder resin, 10 parts by weight of the amine compound of Exemplified Compound No. 1 shown in Table 1 as a charge-transporting substance, 5 parts by weight of 3,5-dimethyl-3',5'-di-t-butyldiphenoquinone, 0.5 parts by weight of 2,6-di-t-butyl-4-methylphenol and 65 parts by weight of THF were dispersed for 12 hours by a ball mill to prepare a coating solution for use in photosensitive layer. After coating the coating solution for use in photosensitive layer on the previously formed intermediate by a Baker applicator, it was dried at a temperature of 110° C. for one hour by hot blow to form a photosensitive layer of 20 μm thickness.

As described above, an electrophotographic photoreceptor of Example 10 having the single type layer structure shown in FIG. 3 was manufactured.

Example 11

An electrophotographic photoreceptor of Example 11 was manufactured in the same manner as in Example 6 except for using X-type non-metal phthalocyanine instead of the azo compound represented by the structural formula (14) as the charge-generating substance.

Examples 12 to 14

Electrophotographic light sensitive bodies of Examples 12 to 14 were manufactured in the same manner as in Example 6 except for using an X-type non-metal phthalocyanine instead of the azo compound represented by the structural formula (14) as a charge-generating substance and using the amine compound of Exemplified Compound No. 10, 28 or 45 shown in Table 1 to Table 7 instead of the amine compound of Exemplified Compound No. 1 as a charge-transporting substance.

Comparative Examples 5, 6

Electrophotographic photoreceptors of Comparative Examples 5 and 6 were manufactured in the same manner as in Example 6 except for using an X-type non-metal phthalocyanine instead of the azo compound represented by the structural formula (14) as a charge-generating substance and using Comparative Compound A represented by the structural formula (12) or Comparative Compound B represented by the structural formula (13) instead of the amine compound of Exemplified Compound No. 1 as the a transportation material.

[Evaluation 2]

For each of the photoreceptors of Examples 6 to 14 and Comparative Examples 3 to 6 manufactured as described above, initial characteristics and repetitive characteristics were evaluated by using an electrostatic copy paper testing apparatus (EPA-8200: manufactured by Kawaguchi Denki Manufacturing Co.). Evaluation was conducted under each of circumstances, that is, under a normal temperature/normal humidity (N/N) circumstance at a temperature of 22° C. and at a relative humidity of 65% (65% RH) and under a low temperature/low humidity (L/L) circumstance at a temperature of 5° C. and at a relative humidity of 20% (20% RH), respectively.

The initial characteristics were evaluated as described below. The surface of a photoreceptor was charged by applying a voltage at minus (−) 5 kV. The surface potential of the photoreceptor was measured as a charged potential $V_0$ (V) and evaluated such that the chargeability was more excellent as the absolute value of the charged potential $V_0$ was higher. However, in a case of a single layered type photoreceptor of Example 10, the surface of the photoreceptor was charged by applying a voltage at plus (+) 5 kV.

Then, exposure was applied to the charged surface of the photoreceptor. The exposure energy required for decreasing the surface potential of the photoreceptor from the charged potential $V_0$ to one-half level was measured as one-half decay exposure amount $E_{1/2}$ (μJ/cm$^2$) and it was evaluated such that the sensitivity was more excellent as the half-decay exposure amount $E_{1/2}$ was smaller. Further, the surface potential of the photoreceptor at the lapse of 10 sec from the start of the exposure was measured as the residual potential $V_r$ (V) and it was evaluated such that the light responsiveness was more excellent as the absolute value of the residual potential $V_r$ was smaller. In the exposure, a white light at an exposure energy of 1 μW/cm$^2$ was used in a case of photoreceptors using the azo compound represented by the structural formula (14) as a charge-generating substance, and a coherent light at a wavelength of 780 nm and at an exposure energy of 1 μW/cm$^2$ obtained by spectrolyzation using a monochrometer was used in a case of photoreceptors of Examples 11 to 14 and Comparative Examples 5, 6 using the X-type non-metal phthalocyanine as a charge-generating substance.

The repetitive characteristics were evaluated as described below. After repeating the procedure of the charge and the exposure described above as one cycle for 5000 times, the charged potential $V_0$, the one-half decay exposure amount $E_{1/2}$ and the residual potential $V_r$ were measured in the same manner as in the evaluation for the initial characteristics, and the chargeability, the sensitivity and the light responsiveness were evaluated.

The results of measurement described above are shown in Table 9.

TABLE 9

| | | | Under N/N circumstance (22° C./65% RH) | | | |
|---|---|---|---|---|---|---|
| | Charge-generating substance | Charge-transporting substance | Initial stage | | | After repetitive use |
| | | | $E_{1/2}$(μJ/cm$^2$) | $V_0$(V) | $V_r$(V) | $E_{1/2}$(μJ/cm$^2$) |
| Example 6 | Azo compound (14) | Exemplified Compound 1 | 0.17 | −580 | −20 | 0.19 |
| Example 7 | Azo compound (14) | Exemplified Compound 18 | 0.15 | −580 | −21 | 0.17 |
| Example 8 | Azo compound (14) | Exemplified Compound 25 | 0.18 | −584 | −21 | 0.20 |
| Example 9 | Azo compound (14) | Exemplified compound 38 | 0.16 | −582 | −18 | 0.19 |
| Comp. Example. 3 | Azo compound (14) | Comparative Compound A | 0.23 | −577 | −32 | 0.25 |
| Comp. Example. 4 | Azo compound (14) | Comparative Compound B | 0.22 | −586 | −38 | 0.24 |
| Example 10 | Azo compound (14) | Exemplified Compound 1 | 0.24 | 554 | 14 | 0.26 |
| Example 11 | X-type non metal phthalocyanine | Exemplified Compound 1 | 0.13 | −578 | −15 | 0.16 |
| Example 12 | X-type non metal phthalocyanine | Exemplified Compound 10 | 0.14 | −574 | −17 | 0.17 |
| Example 13 | X-type non metal phthalocyanine | Exemplified Compound 28 | 0.12 | −581 | −18 | 0.15 |
| Example 14 | X-type non metal phthalocyanine | Exemplified Compound 45 | 0.13 | −579 | −21 | 0.15 |
| Comp. Example. 5 | X-type non metal phthalocyanine- | Comparative Compound A | 0.15 | −580 | −28 | 0.18 |
| Comp. Example. 6 | X-type non metal phthalocyanine | Comparative Compound B | 0.17 | −582 | −30 | 0.22 |

TABLE 9-continued

| | Under N/N circumstance (22° C./65% RH) After repetitive use | | Under L/L circumstance (5° C./20% RH) Initial stage | | | After repetitive use | | |
|---|---|---|---|---|---|---|---|---|
| | $V_0$(V) | $V_r$(V) | $E_{1/2(\mu J/cm^2)}$ | $V_0$(V) | $V_r$(V) | $E_{1/2(\mu J/cm^2)}$ | $V_0$(V) | $V_r$(V) |
| Example 6 | −575 | −29 | 0.18 | −581 | −24 | 0.22 | −570 | −33 |
| Example 7 | −577 | −29 | 0.16 | −581 | −24 | 0.20 | −569 | −31 |
| Example 8 | −578 | −33 | 0.19 | −578 | −27 | 0.23 | −564 | −35 |
| Example 9 | −568 | −36 | 0.15 | −579 | −24 | 0.21 | −560 | −35 |
| Comp. Example. 3 | −568 | −38 | 0.36 | −576 | −49 | 0.44 | −567 | −58 |
| Comp. Example. 4 | −578 | −60 | 0.28 | −577 | −71 | 0.31 | −564 | −80 |
| Example 10 | 578 | 39 | 0.27 | 550 | 30 | 0.33 | 530 | 40 |
| Example 11 | −567 | −32 | 0.15 | −580 | −24 | 0.18 | −570 | −36 |
| Example 12 | −566 | −28 | 0.16 | −574 | −13 | 0.20 | −567 | −29 |
| Example 13 | −571 | −23 | 0.14 | −581 | −14 | 0.18 | −571 | −30 |
| Example 14 | −574 | −32 | 0.12 | −586 | −24 | 0.19 | −565 | −32 |
| Comp. Example. 5 | −571 | −38 | 0.18 | −577 | −35 | 0.21 | −566 | −48 |
| Comp. Example. 6 | −574 | −41 | 0.19 | −571 | −30 | 0.24 | −562 | −39 |

From the result of evaluation for the initial characteristics under the N/N circumstance, it was found that the photoreceptors of Examples 6 to 9 and 11 to 14 using the amine compound of the invention represented by general formula (1) as the charge-transporting substance had high sensitivity showing smaller half-decay exposure amount $E_{1/2}$, and were excellent in the responsivity showing smaller absolute value of the residual potential $V_r$, compared with the light sensitive bodies of Comparative Examples 3 to 6 using Comparative Compound A or B as the charge-transporting substance. Further, it was found that the photoreceptor of Example 10 using the amine compound of the invention represented by the general formula (1) as the charge-transporting substance was excellent in the light responsiveness showing smaller absolute value of the residual potential $V_r$, compared with the laminated type photoreceptors of Comparative Examples 3 and 4 although it was the single layered type.

Further, from the comparison between Examples 6 to 9 and Example 10, it was found that the laminated type photoreceptors of Examples 6 to 9 had higher sensitivity showing smaller half-decay exposure amount $E_{1/2}$, compared with the single layered type photoreceptor of Example 10.

Further, from comparison between the result of measurement under the N/N circumstance and the result of the measurement under the L/L circumstance, it was found that the photoreceptors of Examples 6 to 14 showed less difference between the result of measurement under the N/N circumstance and the result of measurement under the LIL circumstance, were excellent in the circumstantial stability, and had sufficient sensitivity and light responsiveness also under the L/L circumstance.

Further, from the comparison between the initial characteristics and the repetitive characteristics, it was found that the photoreceptors of Examples 6 to 14 had less difference between the initial characteristics and the repetitive characteristics and were excellent in electrical durability both under the N/N circumstance and under the L/L circumstance.

Example 15

9 parts by weight of dendritic titanium oxide surface treated with aluminum oxide (chemical formula: $Al_2O_3$) and zirconium dioxide (chemical formula: $ZrO_2$) (TTO-D-1: manufactured by Ishihara Industry Co.) and 9 parts by weight of a copolymerized nylon resin (CM 8000: manufactured by Toray Co.) were added to a solvent mixture comprising 41 parts by weight of 1,3-dioxolan and 41 parts by weight of methanol, and dispersed for 8 hours by using a paint shaker to prepare a coating solution for use in intermediate layer. The coating solution for use in intermediate layer was filled in a coating tank, and a cylindrical conductive support formed of aluminum having 40 mm diameter and 340 mm length in the longitudinal direction was dipped into and then pulled up from the coating tank and dried to form an intermediate layer of 1.0 μm thickness on the conductive support.

Then, 2 parts by weight of oxotitanium phthalocyanine (in which $R^7$, $R^8$, $R^9$ and $R^{10}$ each represent a hydrogen atom in the general formula (A)) having a crystal structure which shows a diffraction peak at least at a Bragg's angle 2θ (error: 2θ=0.2°) of 27.2° in the X-ray diffraction spectrum to Cu—Kα characteristic X-ray (wavelength: 1.54 Å), 1 part by weight of a polyvinyl butyral resin (Esrex BM-S: manufactured by Sekisui Chemical Industry Co.) and 97 parts by weight of methyl ethyl ketone were mixed and dispersed by a paint shaker to prepare a coating solution for use in charge-generating layer. The coating solution for use in charge-generating layer was coated on an intermediate layer by the same dip coating method as for the previously formed intermediate layer, and dried to form a charge-generating layer of 0.4 μm thickness.

Then, 10 parts by weight of the amine compound of Exemplified Compound No. 1 shown in Table 1 as the charge-transporting substance, 20 parts by weight of a polycarbonate resin as binder resin (Upiron Z200: manufactured by Mitsubishi Engineering Plastics Co.), 1 part by weight of 2,6-di-t-butyl-4-methylphenol, and 0.004 parts by weight of dimethyl polysiloxane (KF-96: manufactured by Shinetsu Chemical Industry Co.) were dissolved in 110 parts by weight of THF, to prepare a coating solution for use in charge-transporting layer. After coating the coating solution for use in charge-transporting layer on the previously formed charge-generating layer by the same dipping coating method as for the previously formed intermediate layer, it was dried at a temperature of 110° C. for one hour to form a charge-transporting layer of 23 μm thickness.

As described above, an electrophotographic photoreceptor of Example 15 having the laminated type layer structure shown in FIG. 2 was manufactured.

Examples 16, 17

Electrophotographic photoreceptors of Examples 16 and 17 were manufactured in the same manner as in Example 15 except for using the amine compound of Exemplified Compound No. 18 or 25 shown in Table 1 to Table 7 instead of the amine compound of Exemplified Compound No. 1 as a charge-transporting substance.

Comparative Example 7

An electrophotographic photoreceptor of Comparative Example 7 was manufactured in the same manner as in Example 15 except for using Comparative Compound A represented by the following structural formula (12) instead of the amine compound of Exemplified Compound No. 1 as a charge-transporting substance.

Example 18

An electrophotographic photoreceptor of Example 18 was manufactured in the same manner as in Example 15 except for changing the amount of the polycarbonate resin as the binder resin to 25 parts by weight in forming the charge-transporting layer.

Examples 19, 20

Electrophotographic photoreceptors of Examples 19 and 20 were manufactured by the same manner as in Example 15 except for changing the amount of the polycarbonate resin as a binder resin to 25 parts by weight and using the amine compound of Exemplified Compound No. 25 or 50 shown in Table 1 to Table 7 instead of the amine compound of Exemplified Compound No. 1 as a charge-transporting substance in forming the charge-transporting layer.

Example 21

An electrophotographic photoreceptor of Example 21 was manufactured in the same manner as in Example 15 except for changing the amount of the polycarbonate resin as the binder resin to 10 parts by weight in forming the charge-transporting layer.

Reference Example

An electrophotographic photoreceptor was manufactured in the same manner as in Example 15 except for changing the amount of the polycarbonate resin as the binder resin to 31 parts by weight in forming the charge-transporting layer. However, since the polycarbonate resin was not dissolved completely to increase the viscosity of the coating solution for use in charge-transporting layer with THF in the same amount as that in Example 15, THF was added to prepare a coating solution for use in charge-transporting layer in which the polycarbonate resin was dissolved completely and a charge-transporting layer was formed by using the same.

However, clouding due to a brushing phenomenon was caused to longitudinal ends of the cylindrical photoreceptor and the characteristic evaluation shown by the following Evaluation 3 could not be conducted. It is considered that the brushing phenomenon was attributable to that the amount of the solvent in the coating solution for use in charge-transporting layer was excessive.

[Evaluation 3]

Each of the photoreceptors of Examples 15 to 21 and Comparative Example 7 manufactured as described above was mounted to a testing copying machine modified from a commercially available digital copying machine AR-C150 (trade name of products, manufactured by Sharp Corp.) such that the circumferential rotational speed of the photoreceptor was 117 mm on every sec respectively, and the printing resistance, the electrical characteristics and the circumstantial stability of each photoreceptor were evaluated as described below. The digital copying machine AR-C150 is a negatively charged type image forming apparatus of conducting the electrophotographic process by negatively charging the surface of the photoreceptor.

(a) Printing Resistance

After forming test images of a predetermined pattern to 40,000 sheets of recording paper by using the testing copying machine, the mounted photoreceptor was taken out, and thickness d1 of the light sensitive layer of the photoreceptor taken out was measured to determine the difference between the value (d1) and the thickness d0 of the photosensitive layer before the test use as a film reduction amount Δd (=d0−d1), which was used as the evaluation index for the printing resistance. Measurement ofr the film thickness was conducted by an instantaneous multi-light measuring system MCPD-1100 (manufactured by Otsuka Denshi Co.) by a light interference method.

(b) Electric Characteristics and Circumstantial Stability

The developing device was detached from the testing copying machine and, instead, a surface potential meter (CATE751, manufactured by Gentec Co.) was provided to the developing portion. Using the copying machine, the surface potential of the photoreceptor in a case not exposing the laser light was measured as the charge potential V1 (V) under a normal temperature/normal humidity (N/N) circumstance at a temperature of 22° C. and a relative humidity of 65%. Further, the surface potential of the photoconductor after applying the laser light exposure was measured as an exposure potential VL (V), which was determined as an exposure potential $VL_N$ under the N/N circumstance. It was evaluated that the chargeability was more excellent as the absolute value of the charging potential V1 was larger and the light responsiveness was evaluated to be more excellent as the absolute value of the exposure potential $VL_N$ was smaller.

Further, the exposure potential VL (V) was measured under the low temperature/low humidity (L/L) circumstance at a temperature of 5° C. and at a relative humidity of 20% in the same manner as under the N/N circumstance, which was determined as the exposure potential $VL_L$ under the L/L circumstance. The absolute value of the difference between the exposure potential $VL_N$ under the N/N circumstance and the exposure potential $VL_L$ under the L/L circumstance was determined as potential fluctuation ΔVL (=|$VL_L$−$VL_N$|). It was judged that as the potential fluctuation ΔVL was smaller, the circumstantial stability was more excellent.

Table 10 shows the results for the evaluation.

TABLE 10

| | Charge-transporting substance | Charge-transporting substance/ binder resin | Film reduction amount Δd (μm) | N/N-potential characteristic V1(V) | N/N-potential characteristic $VL_N$(V) | L/L-potential fluctuation Δ VL(V) |
|---|---|---|---|---|---|---|
| Example 15 | Exemplified Compound 1 | 10/20 | 3.5 | −541 | −40 | 25 |
| Example 16 | Exemplified Compound 18 | 10/20 | 3.5 | −544 | −37 | 26 |
| Example 17 | Exemplified Compound 25 | 10/20 | 3.8 | −538 | −39 | 26 |
| Comp. Example 7 | Comparative Compound A | 10/20 | 4.5 | −520 | −107 | 76 |
| Example 18 | Exemplified Compound 1 | 10/25 | 2.9 | −530 | −48 | 32 |
| Example 19 | Exemplified Compound 25 | 10/25 | 2.8 | −527 | −49 | 30 |
| Example 20 | Exemplified Compound 50 | 10/25 | 2.6 | −521 | −50 | 31 |
| Example 21 | Exemplified Compound 1 | 10/10 | 10.8 | −520 | −20 | 12 |
| Reference Example | Exemplified Compound 1 | 10/31 | — | — | — | — |

In view of the comparison between Examples 15 to 20 and Comparative Example 7, it was found that the photoreceptors of Examples 15 to 20 using the amine compound shown by the general formula (1) as the charge-transporting substance showed smaller absolute value of the exposed potential $VL_N$ under the N/N circumstance and were excellent in the light responsiveness even in a case of defining the ratio between the weight of the charge-transporting substance and the weight of the binder resin (charge-transporting substance/binder resin) as 10/12 or less and the binder resin was added at a high ratio. The photoreceptors of Examples 15 to 20 were more excellent in the circumstantial stability with less smaller value of potential fluctuation ΔVL and showed a sufficient light responsiveness even under the L/L circumstance compared with the photoconductor of Comparative Example 7.

Further, in view of comparison between Examples 15 to 20 and Example 21, it was found that the photoreceptors of Example Specimens 15 to 20 in which the ratio between the weight A of the enamine compound shown by the general formula (1) and the weight B of the binder resin (A/B) was within the range from 10/30 to 10/12 showed smaller film reduction amount Δd and had higher printing resistance than the photoreceptor of Example Specimen 21 in which the ratio A/B exceeded 10/12 and the ratio of the binder resin was low.

As described above, it was found that the enamine compound shown by the general formula (1) had high charge mobility. Further, by the incorporation of the enamine compound shown by the general formula (1) as the charge-transporting substance to the photosensitive layer, a electrophotographic photoreceptor excellent in the chargeability, sensitivity and light responsiveness, as well as excellent in the circumstantial stability and the electrical durability could be obtained. Further, by the use of the amine compound shown by the general formula (1) as the charge-transporting substance, the ratio between the weight of the charge-transporting substance and the weight of the binder resin in the charge-transporting layer (charge-transporting substance/binder resin) can be set to 10/30 or more and 10/12 or less to increase the ratio of the binder resin to thereby improve the printing resistance of the charge-transporting layer without lowering the light responsiveness.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. An amine compound represented by the following general formula (1):

(1)

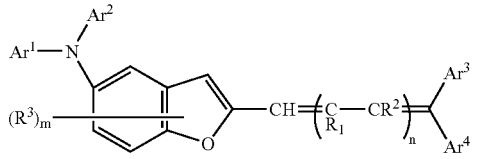

in the formula (1), $Ar^1$, $Ar^2$, and $Ar^3$ each represent an aryl group which may have a substituent, a heterocycle group which may have a substituent, an aralkyl group which may have a substituent or a thienyl methyl group which may have a substituent; and $Ar^4$ represents a hydrogen atom, an alkyl group which may have a substituent, an aryl group which may have a substituent, a heterocycle group which may have a substituent or an aralkyl group which may have a substituent; $Ar^3$ and $Ar^4$ may also form a ring structure together with a carbon atom bonded thereto; $R^1$ and $R^2$ each represent a hydrogen atom, an alkyl group which may have a substituent, an aryl group which may have a substituent, a heterocycle group which may have a substituent or an aralkyl group which may have a substituent; n represents an integer of 1 or 2, and in a case where n is 2, two $R^1$s may be identical or different and two $R^2$s may be identical or different; $R^3$ represents an alkyl group of 1 to 3 carbon atoms which may have a substituent, a fluoroalkyl group of 1 to 5 carbon atoms which may have a substituent, a perfluoroalkyl group of 1 to 5 carbon atoms, an alkoxy group of 1 to 3 carbon atoms which may have a substituent, a dialkyl amino group of 2 to 8 carbon atoms which may have a substituent, a halogen atom or a hydrogen atom; m represents an integer of 1 to 4, and in a case where m is 2 or more, plural $R^3$s may be identical or different.

2. The amine compound of claim 1, wherein the amine compound is an amine compound with n=1 in the general formula (1).

3. The amine compound of claim 1, wherein the amine compound is an amine compound represented by the following general formula (2):

(2)

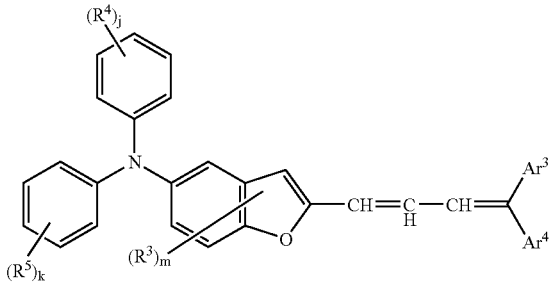

in the formula (2), $R^4$ and $R^5$ each represent an alkyl group of 1 to 3 carbon atoms which may have a substituent, a fluoroalkyl group of 1 to 5 carbon atoms which may have a substituent, a perfluroalkyl group of 1 to 5 carbon atoms, an alkoxy group of 1 to 3 carbon atoms which may have a substituent, a dialkylamino group of 2 to 8 carbon atoms which may have a substituent, a halogen atom or a hydrogen atom; j and k each represent an integer of 1 to 5, and in a case where j is 2 or more, plural $R^4$s may be identical or different and in a case where k is 2 or more, plural $R^5$s may be identical or different; $Ar^3$, $Ar^4$, $R^3$ and m have the same meanings as those defined in the general formula (1).

4. An electrophotographic photoreceptor comprising:

a conductive support formed of a conductive material; and a photosensitive layer provided on the conductive support and containing a charge-generating substance and a charge-transporting substance, wherein the charge-transporting substance contains the above-described amine compound of claim 1.

5. The electrophotographic photoreceptor of claim 4, wherein the charge-generating substance contains an oxotitanium phthalocyanine compound.

6. The electrophotographic photoreceptor of claim 5, wherein the oxotitanium phthalocyanine compound is an oxotitanium phthalocyanine compound having a crystal structure which shows a diffraction peak at least at a Bragg angle 2θ (error: ±0.2°) of 27.2° in an X-rays diffraction spectrum relative to Cu—Kα characteristic X-ray (wavelength: 1.54 Å).

7. The electrophotographic photoreceptor of claim 4, wherein the photosensitive layer has a laminated structure formed by laminating a charge-generating layer containing the charge-generating substance and a charge-transporting layer containing the charge-transporting substance.

8. The electrophotographic photoreceptor of claim 7, wherein the charge-transporting layer further contains a binder resin, and a ratio A/B between weight A of the amine compound represented by the general formula (1) and weight B of the binder resin in the charge-transporting layer is 10/30 or more and 10/12 or less.

9. The electrophotographic photoreceptor of claim 4, further comprising an intermediate layer between the conductive support and the photosensitive layer.

10. An image forming apparatus comprising:

the electrophotographic photoreceptor of claim 4;

charging means for charging the electrophotographic photoreceptor;

exposure means for applying exposure to the charged electrophotographic photoreceptor; and developing means for developing an electrostatic latent image formed by exposure.

* * * * *